United States Patent [19]

Rohner et al.

[11] 4,397,138

[45] Aug. 9, 1983

[54] METHOD AND DEVICE FOR JOINING TEXTILE THREADS BY SPLICING WITH THE AID OF COMPRESSED AIR

[75] Inventors: Joachim Rohner; Heinz Zumfeld; Ivica Romic, all of Monchen-Gladbach, Fed. Rep. of Germany

[73] Assignee: W. Schlafhorst & Co., Mönchengladbach, Fed. Rep. of Germany

[21] Appl. No.: 289,224

[22] Filed: Aug. 3, 1981

[30] Foreign Application Priority Data

Aug. 2, 1980 [DE] Fed. Rep. of Germany ..... 3029431
Aug. 2, 1980 [DE] Fed. Rep. of Germany ..... 3029452
Apr. 8, 1981 [DE] Fed. Rep. of Germany ..... 3114160

[51] Int. Cl.[3] ..... D01H 15/00
[52] U.S. Cl. ..... 57/22; 57/261
[58] Field of Search ..... 57/22, 23, 261, 262, 57/263

[56] References Cited

U.S. PATENT DOCUMENTS 3,942,311 3/1976 Stahlecker ..... 57/1 UN
4,240,247 12/1980 Matsui et al. ..... 57/22 X
4,246,744 1/1981 Matsui et al. ..... 57/22
4,263,775 4/1981 Mima ..... 57/261 X

*Primary Examiner*—Donald Watkins
*Attorney, Agent, or Firm*—Herbert L. Lerner; Laurence A. Greenberg

[57] ABSTRACT

Method of joining textile threads, respectively, formed of a plurality of twisted-together filaments by splicing the threads with the aid of compressed air, the threads being inserted into a splicing chamber having a compressed-air channel communicating therewith, the threads being fed from two sides of the splicing chamber and being held by respective thread holding members, which includes, prior to splicing the threads, freeing the threads of the twist formed therein in a region thereof at which the splicing connection is to be formed.

23 Claims, 17 Drawing Figures

14
60
65
12
153
13'
64
147
126
151
72
143
105
11
128
108
106
110
139
120
111
54
142
62
117
152
149
116
118
107
55
109
129
56
197
71
127
57
198
12'
154
58
13
59
61

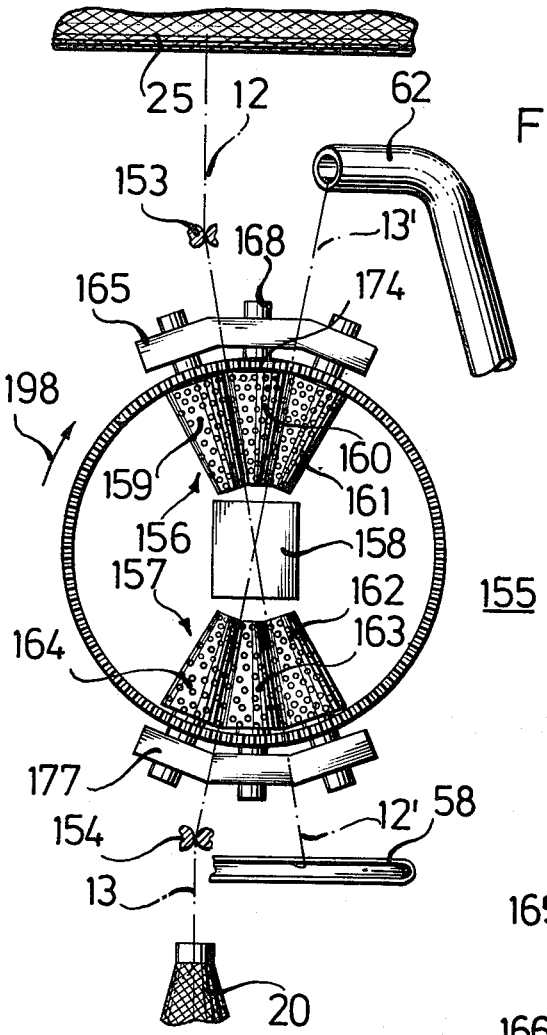
FIG. 10
FIG. 11
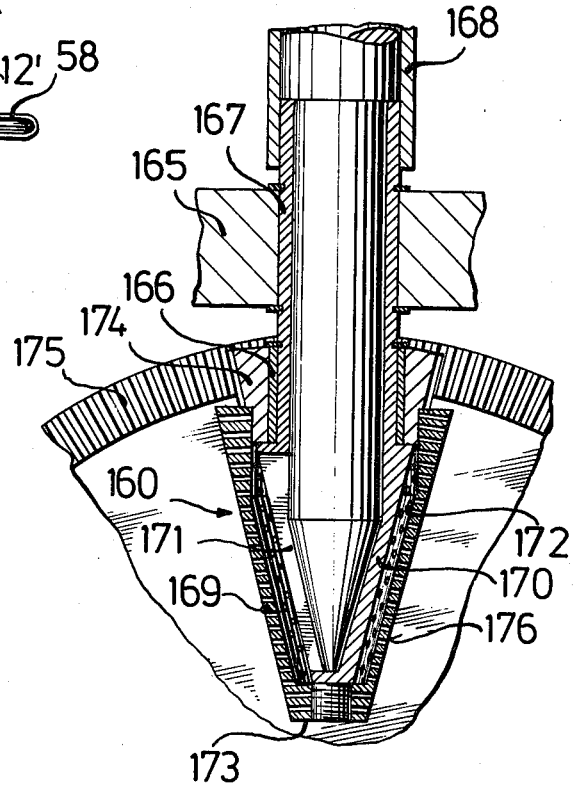

METHOD AND DEVICE FOR JOINING TEXTILE THREADS BY SPLICING WITH THE AID OF COMPRESSED AIR

The invention relates to a method and device for joining textile threads, and more specifically such threads formed of a plurality of twisted-together filaments, by splicing the threads with the aid of compressed air and, more particularly, the threads being inserted into a splicing chamber having a compressed-air channel communicating therewith, the threads being fed from two sides of the splicing chamber and being held by respective thread holding members.

Through German Published Non-Prosecuted Application (DE-OS) No. 28 10 741, a compressed-air splicing method and device have become known, the use of which is supposed to eliminate all quality-reducing influences and influences dependent upon manual dexterity when producing a splice connection.

It has been found, however, that all threads are not equally well suited for splicing. Above all, tightly twisted threads are unable or only able with great difficulty to be spliced with heretofore known methods and devices.

It is accordingly an object of the invention to provide a method and device of the foregoing general type with which a good splice connection can be produced even with tightly twisted threads.

With the foregoing and other objects in view there is provided in accordance with the invention, a method of joining textile threads, respectively formed of a plurality of twisted-together filaments by splicing the threads with the aid of compressed air, the threads being inserted into a splicing chamber having a compressed-air channel communicating therewith, the threads being fed from two sides of the splicing chamber and being held by respective thread holding members, which comprises, prior to splicing the threads, freeing the threads of the twist formed therein in a region thereof at which the splicing connection or splice is to be formed.

Further in accordance with the invention, there is provided a compressed-air splicing device for textile threads, respectively formed of a plurality of twisted-together filaments having a splicing chamber with which a compressed-air channel communicates, and thread holding members for holding respective textile threads inserted into the splicing chamber from two sides thereof, for carrying out the foregoing method comprising a controlled thread-twist changing device disposed in a respective region of the threads extending from the splicing chamber to the respective thread holding members.

If the threads are freed of the twist therein in the region wherein the splice is to be formed, before splicing of the threads occurs, the fibers or filaments of both threads can intermix well during the subsequent compressed-air splicing operation. It is unnecessary, in this regard, to stretch the fibers or filaments, although this can also not be harmful, yet occasionally having disadvantages. It is sufficient merely to free the threads of the twist therein. The individual fibers or filaments are not, therefore, required to be stretched or placed in parallel. Even if the threads are only partly freed of the twist therein, successful splices are possible in specific cases. The less thread twist there is at the splicing location, the better is the splice, in general.

The freeing of the threads from the twist formed therein can occur even before the threads reach the splicing chamber. Thus, made-ready or prepared thread ends can be introduced into the splicing chamber. An advantage thereof is that the appearance of the readied thread ends can be observed at all times. On the other hand, other advantages are afforded if the threads are freed of the twist therein only when they are already located in the splicing chamber. They can then be held fast, namely, by thread grippers disposed outside the splicing chamber so that the thread ends also remain gripped yet. The thread ends themselves are, in this case, not freed of their twist, but rather, the threads are freed of the twist thereof only exactly in the provided region of the splice or splicing connection which, in fact, does not have to be the thread end.

Splicing with compressed air occurs, as is generally known, by whirling about or producing turbulence of the individual fibers or filaments. Also, without additional thread twist applied to the splicing location, a durable splice is generally produced.

Should the threads have very short fibers or filaments, however, it is better to provide the splicing location with a twist after the splicing of the threads has taken place. In accordance with another feature of the invention, in this regard, the thread twist is transferred or shifted out of the region at which the splice is to be formed and into a region of the threads extending from the splicing chamber to the thread holding members or grippers and, after splicing the threads, the twist is freed or released to return to the splice location. This measure is all the more efficient if, above all, the respective thread ends are also held fast, the threads according being freed from the twist therein only when they are already located in the splicing chamber.

After the splicing of the threads, the excess thread ends are conventionally cut off. A better splice is obtained quite without any disturbing thread ends, if the excess thread ends are removed by picking or plucking. This can take place before the splicing and/or during the splicing and/or after the splicing. Which point of time is the most desirable, in this regard, is revealed by the nature or character of the thread. It can often be better to perform the picking or plucking as slowly as possible and, in other cases, as rapidly as possible. The picking or plucking occurs, for example, by slowly applying increased tension to the thread ends so that the excess fibers or filaments slowly loosen from the splicing location. With short fibers or filaments, it may be more desirable, in contrast thereto, to tear off the excess thread ends from the splicing location with a slight yank or jerk, after the splice has been completed.

The hereinaforementioned advantages of the invention are attained through the use of the thread-twist changing or varying device according to the invention, which is disposed in the thread region extending from the splicing chamber to the thread holding member. The thread-twist changing device is controllable and, indeed, not only with respect to the duration of operation and the instant of operation, but also with respect to the extent of the thread-twist change. The thread twist need then not be fully removed. In general, only a transfer or shift of the initially uniform thread twist occurs, to the effect that the threads are freed or released from the twist thereof, in the provided region, while the adjacent regions receive an increased thread twist. It is obvious that the thread-twist hanging device according to the invention takes the direction of thread twist into consideration i.e. whether it is a Z-twist or an S-twist. Otherwise, the inventive idea would not materialize. Care must also be taken that threads of the same twist i.e. either threads having a Z-twist or threads having an S-twist, are joined to one another.

It depends greatly upon the type of construction of the thread-twist changing device whether one thread-twist changing device is installed for each thread or a single thread-twist changing device is to be installed in common for both threads. The type of construction of the thread-twist changing device depends, in turn, upon the nature or characteristic of the threads. In this regard, it is advantageously conspicuous that the instant application proposes a variety of types of construction of thread-twist changing devices according to the invention.

In a simple embodiment of the invention, the thread-twist changing device or member acts solely upon the threads running towards the splicing chamber but not upon the thread ends projecting out of the splicing chamber. The thread ends are removed anyway. At any rate, as mentioned hereinabove, a better splicing result is attained if the thread-twist changing device is able to act both upon the threads leading to the splicing chamber, as well as upon the thread ends projecting out of splicing chamber. With such a construction of the thread-twist changing device, the threads are made-ready in the region of the splice always reproducibly unchanged for splicing.

In accordance with a further feature of the invention, the thread-twist changing device comprises a rotatable thread holding member. In the simplest case, this is a rotary gripper or clamp which takes up the thread and which is then rotated about the longitudinal axis of the thread.

In accordance with an additional feature of the invention, a shifting device is provided operatively associated with the rotatable thread holding member of the thread-twist changing device for shifting the rotatable thread holding member along the axis of the respective thread.

An advantage is thereby provided that the compressd-air splicing device is suited for universal application. With thin threads having short fibers or filaments, for example, the thread holding members are brought closer to the splicing chamber than with thicker threads having longer fibers or filaments. For the purpose of making-ready for the splicing operation, depending upon the thread twist, whether it is a Z-twist or an S-twist, a ring gear driving the thread holding member can be driven so long until the thread twist is released or freed at the splicing location. Because an accumulation or pile-up of twist always occurs behind the thread holding members, the thread twist is provided at the splicing location by reversely rotating the ring gear during loosening or releasing of the twist accumulation or pile-up.

Good splicing results have been attained with a thread-twist changing or varying device according to the invention which has at least one friction surface which is able to be brought into contact with the respective thread and displaceable transversely to the longitudinal direction of the respective thread. It is even better, in accordance with an added feature of the invention, for the thread-twist changing device to have at least two friction surfaces bringable from opposite sides into contact with the respective thread and displaceable away in opposite directions. This applies advantageously for a movement directed away and, following after the splicing operation, directed back again, whereby the thread twist is brought to the completed splice not only due to the release of the threads alone, but also, additionally due to enforced twisting at the completed splice.

The friction surfaces may lie at the surface of a taper or belt-like, roller-like or cylindrical tapered or conical, annular or ring-shaped or disk-shaped member. The friction surfaces disposed opposite one another thus lie against or engage the respective thread. If both friction surfaces are moved at the same speed transversely to the longitudinal direction of the thread, the thread rotates about its own axis but remains in the direction thereof also remains gripped or clamped. It is thereby advantageous to produce the friction surfaces by using a material with a high coefficient of friction, especially by using a rubber-elastic material or thermoplastic synthetic material. Above all, it ought not to be a rough surface on which the fibers can hook.

A simple and especially efficient device is produced, in accordance with yet another feature of the invention by providing the thread-twist changing device with two oppositely rotatable, drivable halves formed with ring disk-like rims and surrounding the splicing chamber basket-like or pot-like, the rims thereof carrying the friction surfaces which are able to be brought into contact with the threads. These two halves of the thread-twist changing device thus enclose the slicing chamber. If the halves are opened, the threads can be introduced into the splicing chamber, preferably crossed. The crossing of the threads when they are inserted has various advantages. One advantage is produced if the splicing chamber is exactly centrally disposed, and the threads exactly radially, however, spaced from one another, are guided through the thread-twist changing device. If the two halves of the thread-twist changing device then rotate opposite to one another, the threads rotate exactly about the longitudinal axis thereof which remains spatially fixed. The size of the adjustable angle of rotation through which both halves of the thread-twist changing device, when the threads are inserted, are rotated opposite to one another, and also the rotary direction are dependent upon the thread dimensions and upon the thread twist.

Instead of the last-mentioned emodiment of the thread-twist changing device, another embodiment in accordance with the invention may be provided wherein the thread-twist changing device has a plurality of rollers, either a roller pair or a roller group, which are rotatable in the same direction about the longitudinal axes thereof and are spaced from one another a distance less than the diameter of the respective thread. In accordance with yet further features of the invention, the rollers of the roller pairs or groups are tapered or conical, and the reduced-diameter end thereof is directed towards the splicing chamber. The longitudinal axes of the individual rollers accordingly extend radially toward the splicing chamber. The threads to be spliced are also guided there radially through the splicing chamber. They contact the rollers on a preferably straight-extending surface line. If such a thread-twist changing device has two oppositely-disposed roller groups of three tapered rollers each, then each of the two threads can be guided and held both at the on-running section thereof as well as at the thread end between a respective pair of rollers. The drive of such tapered rollers is quite simply formed if the rollers have gears which mesh with a ring gear common to all of the rollers, in accordance with an additional feature of the invention. In this embodiment of the thread-twist changing device, the surfaces of the rollers are constructed as friction surfaces. They are supposed to make firm contact with the respective thread without damaging it. In accordance with yet another feature of the invention, the rollers are formed as hollow members, for example, hollow cylinders, having a perforation and are connected to a suction-air supply device. The suction air then holds the thread fast and, indeed, the suction effect is strongest at that straight surface line of the roller which is disposed opposite the adjacent roller, respectively, at the shortest spacing therefrom. The effect of the suction air upon the thread prevents undesired slipping of the thread out of the contact line between thread and roller.

The last-mentioned embodiment of the thread-twist changing device has quite a simple construction. The tapered rollers can also be manufactured economically by mass-production. This embodiment is recommended where suction-air supply equipment is already present anyway.

It is expedient for the purpose of the invention for the splicing chamber per se to be optimally constructed and to be accommodated or matched to the presence of a thread-twist changing device. Therefore, it is also advantageous, in accordance with the invention, for the splicing chamber to be provided with a controllable sliding cover instead of a hinged cover. A sliding cover does not require as much free room as a hinged cover and is more simply controllable, especially when the splicing chamber per se has a variably adjustable volume, as in accordance with the invention. This is advisable likewise for accommodating to the universally applicable thread-twist changing device.

The thread-twist changing device can be optimally utilized only when the splicing chamber not only has a variably adjustable volume but also when the size of the blast opening provided in the splicing chamber for delivering air thereto from the compressed-air channel is variably adjustable, in accordance with yet an added feature of the invention. Furthermore, the blast opening is increased or decreased in size in the same sense as the splicing chamber is increased or decreased in volume, in accordance with yet a further feature of the invention. Roughly speaking, when the threads are thin, the splicing chamber is given a small volume, and when the threads are thick, a large volume. Exceptions are also possible in this regard, namely taking into consideration the type and intensity of the thread twist and other characteristics of the thread per se, especially also with regard to the type and length of the fibers or filaments thereof.

In accordance with other features of the invention, at least one side wall of the splicing chamber is adjustably shiftable. The adjustability thereof takes place advantageously parallel to the direction of adjustability of the sliding cover of the splicing chamber. Thus, for example, the adjustable side wall of the splicing chamber is formed as a slider sliding along the bottom and along a bottom opening of the splicing chamber serving to supply compressed air to the chamber. The side wall advantageously forms a structural unit with part of the bottom of the splicing chamber. Production or manufacturing advantages are provided by standardization, if the non-adjustable side wall has the same shape as the adjustable side wall, the bottom parts of both side walls meshing comb-like with one another and, accordingly, for example, forming a blast opening through mutually opposing recesses or cut-outs. The compressed air supply is provided advantageously through a compressed-air supply channel disposed in a housing wherein also all of the parts of the splicing chamber are mounted.

Since the adjustment of the splicing chamber as well as the adjustment of the thread-twist changing device also is supposed to occur in accordance with the thread twist, the staple length and fiber or filament length, respectively, the thread count, the fiber or filament material and the fiber or filament thickness, it is advisable and in accordance with another feature of the invention to provide means for finely adjusting the movement of the adjustably slidable side wall. Such a fine-adjustment device should advantageously be very compact. This requirement is fulfilled if the fine-adjustment device is made up of the following:

(a) a threaded spindle engaging in a female thread which is located in the adjustable side wall, (b) a stationary guidance tube for the threaded spindle provided with a thread, preferably an outer thread, and (c) an adjusting knob connected to the threaded spindle and having a thread, preferably a female thread engaging in the thread of the guidance tube.

If the pitch of the spindle thread corresponds to that of the guidance tube thread, the adjustable side wall cannot shift when the adjusting knob is turned. Only the spindle shifts. If both threads, however, have a slight pitch differential, a very sensitive adjustment of the side wall occurs when the adjusting knob is turned.

After the thread-twist changing device and the splicing chamber have already been sensitively adjusted to the threads to be spliced, increased attention must be given also to removal of the thread ends, in the sense of attaining good splicing results. For one, the thread ends should be as short as possible, for another, the thread ends should also remain as inconspicuous or concealed as possible. Not every thread end permits itself to be picked or plucked or torn off. Disadvantageous fiber or filament lengths and thicknesses requires cutting under certain conditions.

In accordance with the invention, the thread-severing devices for removing the thread ends are constructed as cutting members disposed directly on the sliding cover of the splicing chamber, each of the cutting members having two scissor blades, one of which is arrested or secured on the sliding cover, and the other is a controllable scissor blade. The thread severing is thereby led as close as possible to the splicing chamber.

The thread severing device should naturally not impede the insertion of the threads into the splicing chamber. Therefore, when the sliding cover is open, the scissor blades lie advantageously near the elongated slot of the splicing chamber and, only when the sliding cover has been closed, are they led in front of the splicing chamber and, indeed, advantageously so that, respectively, one scissor blade, preferably the controllable scissor blade, is slid or shifted between the inserted upper thread and the inserted lower thread. The back of the scissor blade faces toward the on-running thread which is not to be severed, while the cutting edge of the blade faces towards the thread end of the other thread which is to be severed. There is no harm if, during the splicing, the thread end which is to be severed is already cut by the yet open scissor blade. Such a cutting location is located already at the later cutting location and, in fact, facilitates the severing of the threads.

It is also advantageous, in accordance with the invention, if the threads are so inserted into the splicing chamber that they engage the bottom of the splicing chamber at the side from which they come and, at the opposite side, in vicinity of the sliding cover, they leave the splicing chamber, and if the aforementioned scissor blade is slid or shifted so between the upper thread and the lower thread that, during the splicing, only little air can escape from the splicing chamber along the on-running upper thread and the on-running lower thread, respectively. The air is then conducted manely in the direction toward the thread ends which are to be severed, which facilitates the severing process, because then the short fibers or filaments originating from the severing location can be blown out immediately with increased air velocity. The on-coming threads, on the other hand, are not caught by the air flow and cannot therefore also be swelled up or unraveled by the splicing air.

Because the thread-twist changing device, the sliding cover and the thread severing device perform movements in somewhat the same direction, in accordance with a further feature of the invention, they are all provided with a common actuating device.

Also, increased attention must be applied to the holder of the splicing chamber, with regard to the function or operation of the previously mentioned parts. In accordance with the invention, a holding device is provided which extends transversely to the travel direction of the thread. The holding device advantageously has two cylindrical hollow members of which one serves as the guidance tube for the previously mentioned threaded spindle of the fine-adjustment device, and the other as the compressed air supply. Both cylindrical hollow members have a common longitudinal axis. One of the hollow members is located at the left-hand side of the splicing chamber and splicing-chamber housing, respectively, and the other at the right-hand side thereof. Thus, the splicing-chamber holder performs a double function. It can simultaneously serve for supporting the thread-twist changing device, for example, due to the fact that one half of the thread-twist changing device is disposed rotatably above the one hollow member, and the other half is disposed rotatably and simultaneously shiftably above the other hollow member. So that then also the sliding cover can be actuated independently of the thread twist changing device, a guide sleeve is advantageously disposed between the guidance tube and the half of the thread-twist changing device located on the guidance tube, the guide sleeve carrying the sliding cover. This guide sleeve may simultaneously be a part of the common actuating device for the thread-twist changing device, the sliding cover and the thread severing device. If the guide sleeve is shifted on the hollow member then, simultaneously, the sliding cover, the thread severing device fastened to the sliding cover and the half of the thread-twist changing device mounted on the guide sleeve are shifted. Because the parts, however, have varying courses of movement, various adjusted hold-back devices are advantageously provided which are adjusted to these varying courses of movement. Such hold-back devices may be flexible couplings, stops, a resiliently yieldable bearing or the like.

Insofar as the type of thread permits, the thread severing devices, in accordance with an additional feature of the invention, are constructed as thread picking or plucking devices. An inconspicuous fiber or filament beard is formed at the splicing location if, after the splicing operation, the excess thread ends are picked or plucked and torn off, respectively. At the tear-off location, the thread had previously been divested of its thread twist, anyway, so that the picking or plucking is facilitated. In accordance with yet an added feature of the invention, the thread plucking or picking device comprises a traveling gripper or clamp which initially holds the thread firmly for the purpose of severing the thread, yet leaves the splice location and entrains the gripped thread end therewith. It is also possible, in accordance with an alternate feature of the invention, to provide a plucking device comprising a respective roller pair engageable with a respective thread for acting thereon. The roller pair holds the thread fast and, for the purpose of picking or plucking at the thread, is set into motion i.e. set in rotation. The speed of the thread picking or plucking can be very sensitively metered with a roller pair according to the invention.

In accordance with the invention, the splicing chamber, the thread-twist changing device and the thread severing devices have a common housing which also carries part of the actuating device, the remaining part of the actuating device has a second housing, and both housing as well as the parts of the actuating device associated with the housings are so constructed as to be mutually couplable. The compressed-air splicing device according to the invention can then be exchanged relatively easily. An exchange can be required, for one, to replace worn parts and, for another, also when thin and very thick threads are to be spliced alternatingly, which are not able or not equally able to be spliced well with one and the same splicing device.

The housings may be connected by two screws to one another. The number of parts of the actuating device to be mutually coupled should be kept as small as possible. The condition is advantageously fulfilled, in accordance with concommitant features of the invention, by providing the aforementioned second housing with two levers actuatable by cam disks, one of the levers serving, in turn, for actuating, in common, both halves of the thread-twist changing device with respect to the rotation thereof, and the other of the levers serving, in turn, for actuating the sliding cover, the thread severing devices and the thread-twist changing device with respect to the approach and removal of the two halves of the latter to and from one another, respectively. In this case, only three disassemblable bars or rods are provided as coupling elements and, in fact, one rod for connecting the second lever with those parts of the actuating device which actuate the sliding cover, the thread severing device and the feed of one half of the thread-twist changing device, as well as two further rods or bars which connect the first lever articulatingly with, respectively, one half of the thread-twist changing device for the purpose of an opposite twist. For this purpose, each half is advantageously provided with a crank pin on which the disassemblable rod or bar is suspended.

Advantageously, the aforedescribed coupling of the actuating elements permits a rapid change of the rotary direction of the thread-twist changing device. The type and manner of effecting this is explained hereinbelow with respect to the description of the embodiments of the invention.

Other features which are considered as characteristic for the invention are set forth in the appended claims.

Although the invention is illustrated and described herein as embodied in a method and device for joining textile threads by splicing by means of compressed air, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 10 is a diagrammatic front view similar to that of the right-hand side of FIG. 4 of a second embodiment of the invention;

FIG. 11 is an enlarged fragmentary sectional view of FIG. 10;

Figure 1:
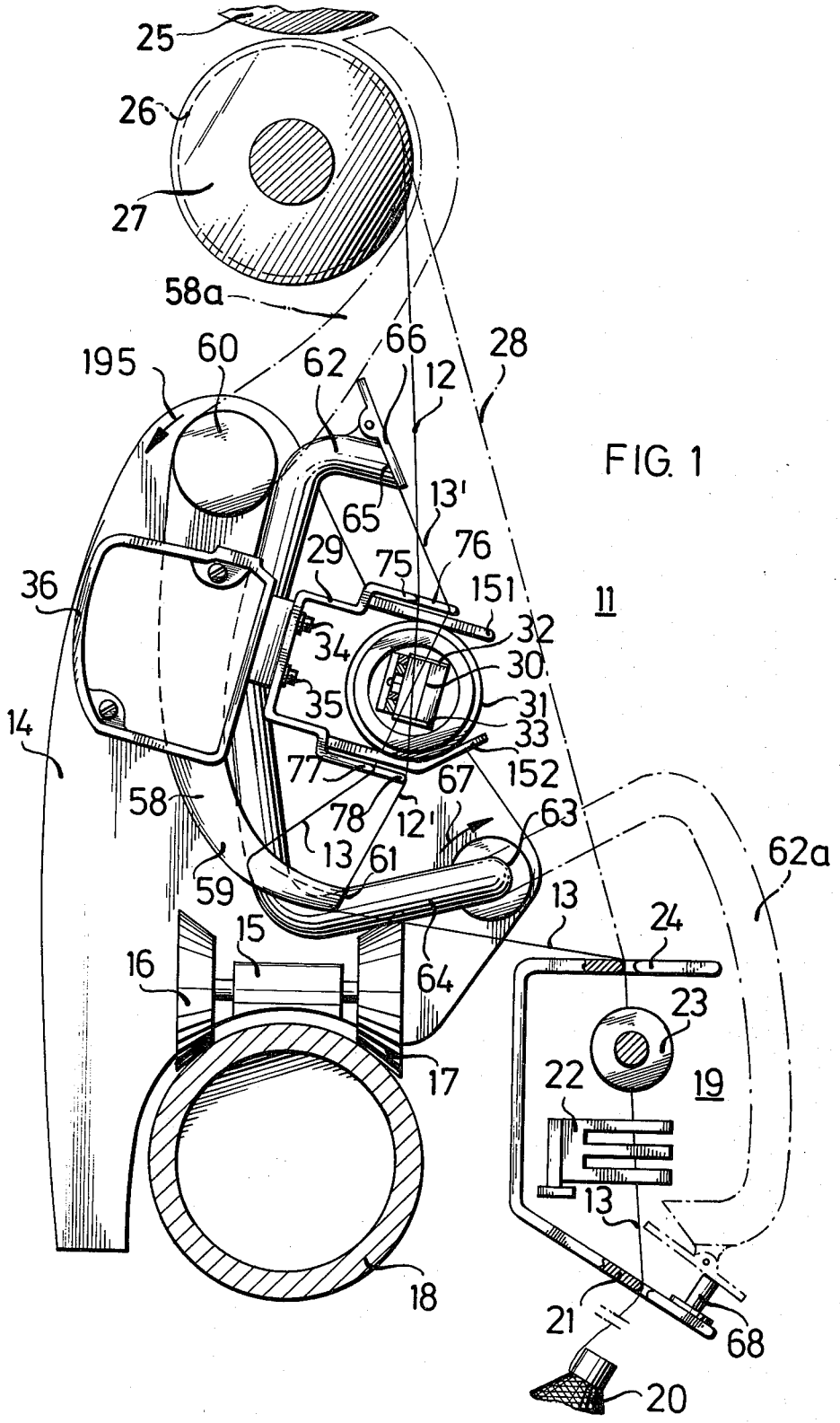
FIG. 1 is a diagrammatic side elevational view of a first embodiment of a device for joining textile threads by splicing with the aid of compressed air, in accordance with the invention.

Referring now to the drawing and first, particularly, to FIGS. 1 to 9 thereof, there is shown a device identified as a whole by reference numeral 11 for joining or connecting an upper thread 12 to a lower thread 13. The device 11 has a machine frame 14 carrying a chassis or undercarriage 15 as shown in FIG. 1. The chassis 15 has rollers 16 and 17 with the aid of which the device 11 is drivable so as to travel on a support tube 18.

The support tube 18 extends along a winding machine of which only one winding station identified as a whole by reference numeral 19 is visible in FIG. 1. The device 11 happens to be working at this winding station 19.

At the winding station 19, the lower thread 13 travels from a cop 20 over a thread guide 21, a calculating or computing sensor 22, a thread brake 23 and a further thread guide 24 to the device 11. The upper thread 12 extends from a take-up coil 25 over a rotating thread guide cylinder 27 provided with reverse winding grooves 26 likewise to the device 11.

In the limited or narrow sense, the device delivering the lower thread 13 is formed of the thread guide 21, and the device taking up the upper thread 12 of the take-up coil 25. The line of the shortest possible, uninfluenced and undisturbed thread travel path or passage is identified by reference numeral 28.

The fact that the line 28 is shown in phantom is supposed to indicate that the thread path has already been disrupted and the thread per se has separated into an upper and a lower thread.

The device 11 has a splicing chamber 30 in a half-open housing 29, a thread-twist changing device 31 and thread severing devices 32 and 33. The housing 29 is coupled by means of screws 34 and 35 to a further housing 36.

Figure 5:
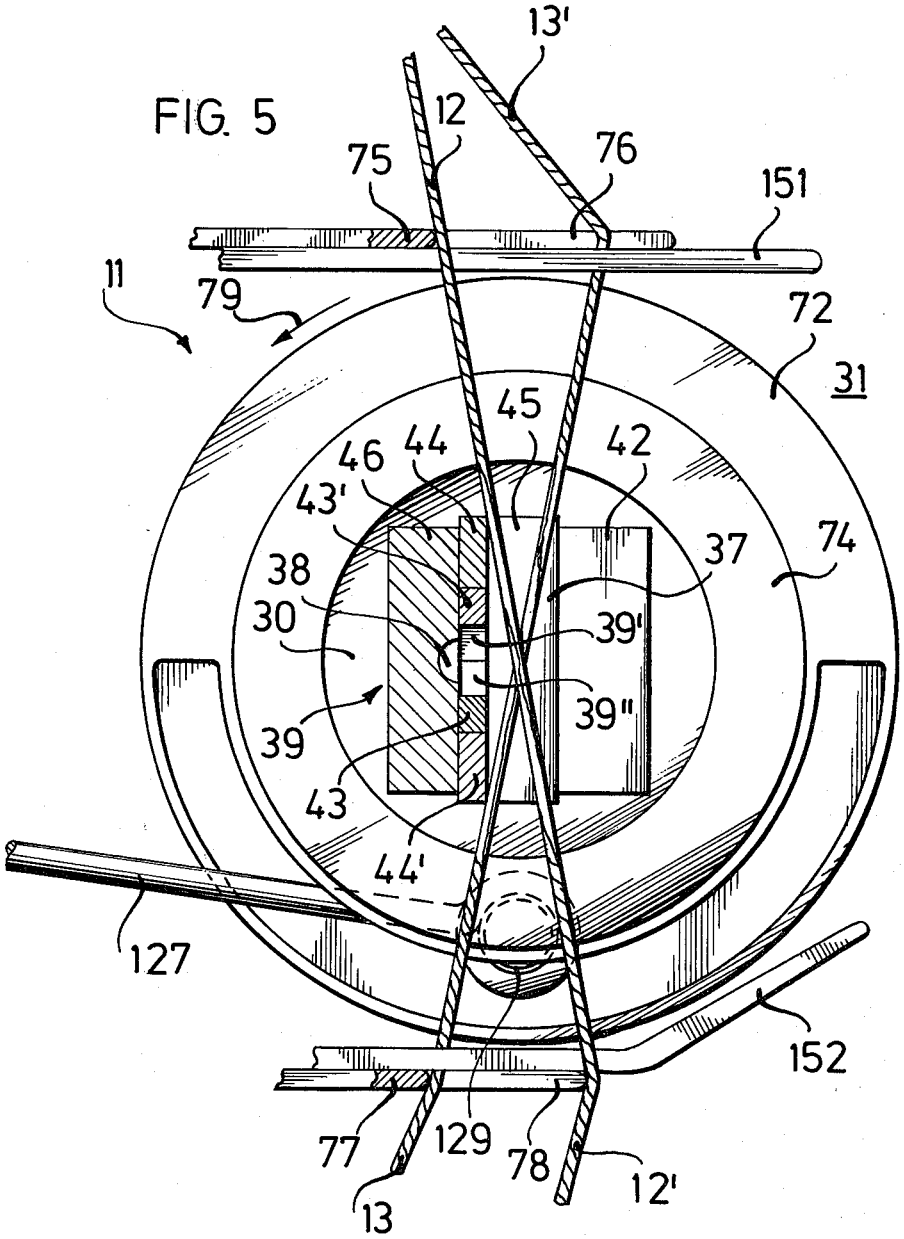
FIG. 5 is an enlarged fragmentary view of FIG. 4 showing the interior of the cut-away splicing chamber.
Figure 7:
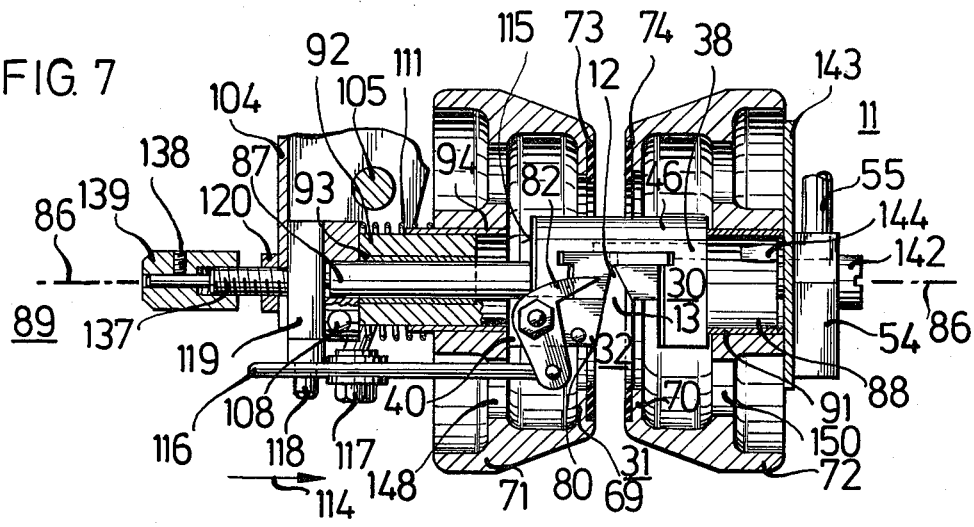
FIGS. 7 to 9 are sectional views of the right hand side of FIG. 3 rotated 90° clockwise showing the first embodiment of the device in three different phases of the production of a splice connection.
Figure 8:
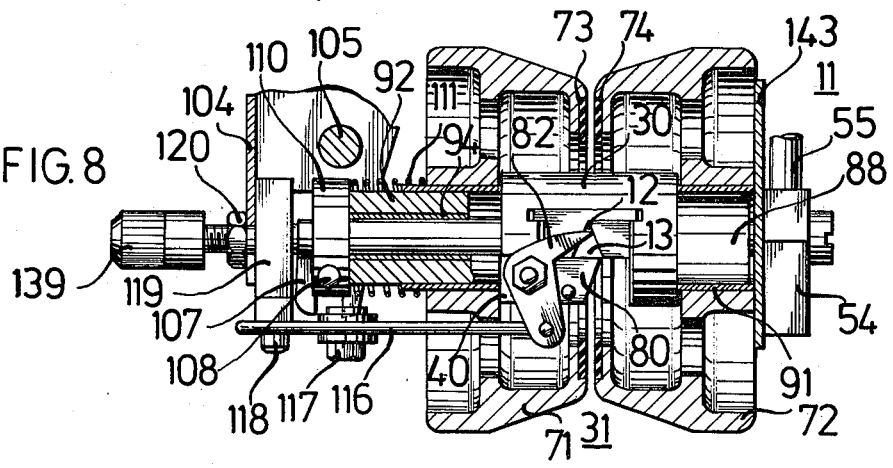

As illustrated especially in FIGS. 5 and 7, the splicing chamber 30 has a coverable elongated slot 37 with a V-shaped cross section. The threads are inserted into and tied in the elongated slot 37 by means of compressed air. A compressed-air supply channel 38 extends into the interior of the splicing chamber 30 i.e. into the elongated slot 37, and terminates at an exhaust or blast opening 39. The splicing chamber 30 has a controllable slide cover 40. The volume of the splicing chamber 30 is variably adjustable. The size of the blast or exhaust opening 39 of the splicing chamber 30 is also variably adjustable and, in fact, the blast opening 39 is also enlarged or reduced in size in the same sense as the volume of the splicing chamber 30 is enlarged or reduced in size.

For the purpose of varying the volume, a side wall 41 (FIG. 6) is adjustable and, in fact, this side wall 41 is formed as a slider sliding along the bottom 42 and the bottom opening 39 serving to supply the compressed air.

Figure 6:
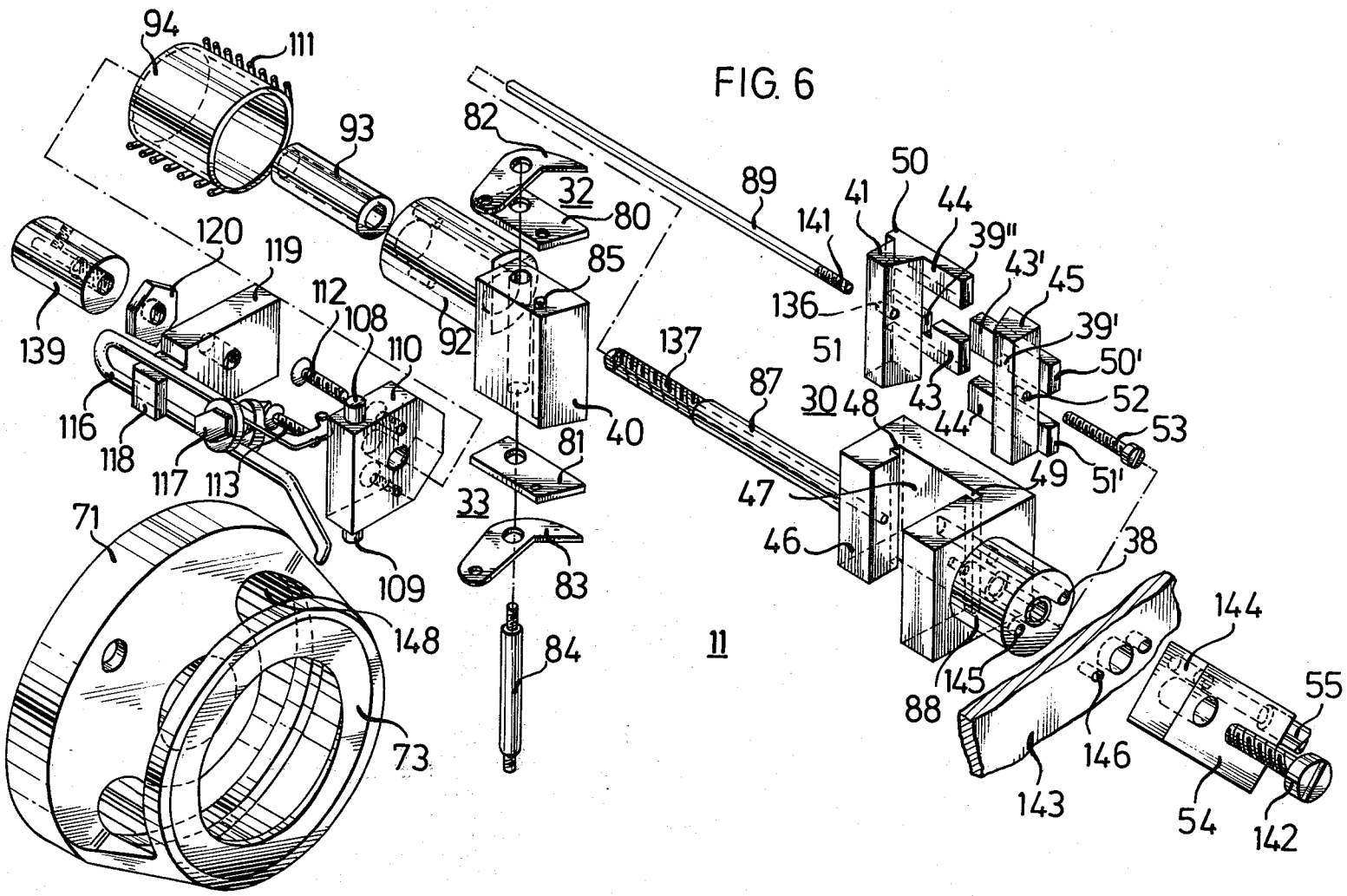
FIG. 6 is an exploded view of the device according to the invention.

As is able to be ascertained especially in the exploded view of FIG. 6, the adjustable side wall 41 of the splicing chamber 30 and the parts 43 and 44 of the bottom of the splicing chamber 30 form a structural unit. A nonadjustable side wall 45 has the same shape as that of the adustable side wall 41. Comb-like intermeshing or intercalated parts 43 and 43' of the bottom form a compressed-air inlet, shown in FIG. 5 in the form of bottom openings 39' and 39''. All of the parts of the splicing chamber 30 are mounted in a housing 46 wherein the hereinaforementioned compressed-air supply channel 38 is located.

Figure 2:
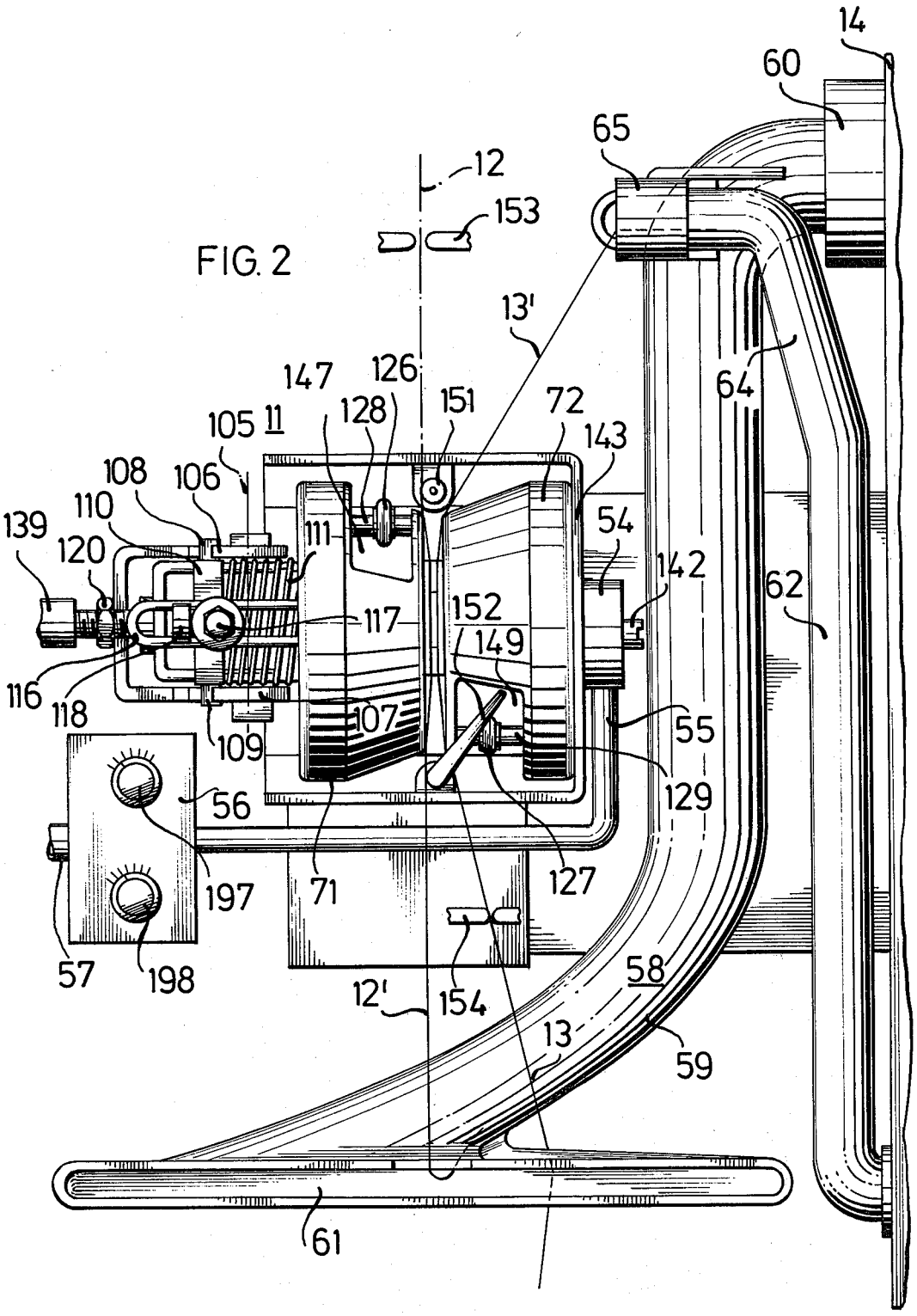
FIG. 2 is an enlarged fragmentary front elevational view of FIG. 1.

The housing 46 of the splicing chamber 11 has a bottom surface 47 at which lateral slots 48 and 49 are provided. The side walls 41 and 45 carry rearwardly extending projection 50 and 51, on the one hand, and 50' and 51', on the other hand, which are accommodated within the aforementioned slots 48 and 49, respectively. The nonadjustable side wall 45 is formed with a threaded bore 52 by which and by means of a screw 53 threaded therein the side wall 45 is fastened in the housing 46. The function of the splicing chamber 30 will be discussed hereinafter in greater detail. The compressed air connection or junction 54 continues in a pipeline 55 which, as shown in FIG. 2, extends to a compressed-air metering valve 56. The compressed-air metering valve 56 is connected at the inlet end thereof by a hose line 57 to an otherwise non-illustrated compressed-air supply line.

As shown especially in FIG. 1, a thread delivery and holding member 58 is provided with means for seeking out and gripping the thread end 12' of the upper thread 12 on the take-up coil 25. These means are formed of an inner hollow arm 59 which is connected at one end via a swivel joint 60 to an otherwise non-illustrated negative pressure source and is formed, for example, as a suction slot nozzle 61 at the free end thereof. FIG. 1 of the drawing shows the thread delivery and holding member 58 is thread delivering or relinquishing position. The thread take-up position of the thread delivery and holding member is represented in phantom at 58*a*.

A further pivotable thr ıd delivery and holding member 62 is provided with means for seeking out and gripping the thread end 13' of the lower thread 13. These means are formed of a crooked tube pivotable in a swivel joint 63 and having a suction nozzle 65 which is closed by a spring-loaded clamping cover 66 and the thread end is thus held clamped. In FIG. 1, the thread delivery and holding member 62 is also illustrated in the thread relinquishing or delivery position thereof shown in solid lines whereas the thread take-up position thereof is shown in phantom at 62*a*. To take up the lower thread 13, the tube 64 is swung downwardly in direction of the arrow 67, the clamping cover 66 opening as it strikes against the stop 68. The lower thread 13 broken somewhat above the thread brake 23 is sucked in by the suction nozzle 65 and, when the thread delivery and holding member 62 swings back into the thread relinquishing or delivery position thereof, is clamped between the clamping cover 66 and the edge of the suction nozzle 65, and firmly held thereby and entrained therewith. The movement of the two thread delivery and holding members 58 and 62 is effected by suitable conventional cam discs located in the machine frame 14.

It is apparent from FIG. 1 that the actuatable or controllable thread-twist changing device 31 is disposed in the thread region extending from the splicing chamber 30 to the thread holding members 58, 61 and 62, 65. It is available in common for both threads 12 and 13 and is able to act upon the threads 12 and 13 leading towards the splicing chamber 30 as well as on the thread ends 12' and 13' held by the thread delivery and holding members 58 and 62 and projecting out of the splicing chamber 30. The thread-twist changing or varying member 31 is constructed in accordance therewith. It has two basket-like or pot-like halves 71 and 72 surrounding the splicing chamber 30 and drivable in opposite rotary directions, the halves 71 and 72 having ring disk-like rims 69 and 70, respectively, which carry friction surface members 73 and 74 which are bringable into contact with the threads. The friction surfaces 73 and 74 are formed as annular inserts using a rubber-elastic material having a high coefficient of friction. It is apparent from FIG. 7 that the rims 69 and 70 of the potlike structure are drawn inwardly on a smaller diameter in order to bring the friction surface members 73 and 74 to a desired spacing from the splicing chamber 30. The spacing of the friction surfaces 73 and 74 is set primarily in accordance with the length of the fibers and in accordance with the length of staple, respectively, of the threads being spliced.

FIGS. 1 and 5 show that, outside the thread-twist changing device 31, thread guiding means 75, 76, 77 and 78 are arranged in connection with the housing 29. These thread guiding means 75 to 78 are represented as steps of the edge of the housing 29. The thread guiding means 75 to 78 are so disposed that, when the halves 71 and 72 of the thread twist changing member 31 are moved apart from one another, the threads being spliced are insertable crossed both into the splicing chamber 30 as well as into the thread twist changing device 31 per se, as shown in FIG. 5 especially. According to FIG. 5, the threads 12 and 13 are guided exactly radially through the thread twist changing device 31. If the friction surface member 73 of the half 71 of the thread twist changing member 31 not shown in FIG. 5 is then brought into engagement with the threads with slight spring force, the threads are also brought into engagement with the friction surface member 74 of the half 72 i.e. are held in position thereof with defined spring force between the friction surface members 73 and 74. If the halves 72 and 71 are then uniformly turned, respectively, in the direction and opposite the direction of the arrow 79, the threads remain in position thereof relative to one another, however, the thread twist changes or is varied in the manner indicated, for example, by the S-turned threads in FIG. 5. Beyond the friction surface members 73 and 74, the thread twist is increased or strengthened, however, in the free part disposed toward the splicing chamber 30, it is loosened. The loosening of the thread twist in vicinity of the splicing chamber 30 is a desired effect which aims at a good splice connection. Simultaneously, the threads are also, however, held fast by the friction surfaces 73 and 74 during the splicing operation. After the splicing operation, the threads are not immediately freed, but rather, by turning both halves 71 and 72 opposite to the further above-mentioned turning direction, the thread twist is changed anew and, in fact, then so that the thread twist, increased and piled up beyond the friction surfaces, is again reversed or returned and directed into the splicing location. Selectively, the splicing location can also receive an increased thread twist, in that the turning-back of both halves of the thread-twist changing member occurs over a larger angle of rotation than for the turning movement effected before the splicing operation. In this regard, the splicing connection is initially more firmly or tightly turned than the thread so that it cannot be pulled apart when the thread tension is again applied. Due to subsequent further travel of the thread over different rerouting or deflection locations, an equalization or balancing of the thread twist occurs so that, finally, a splice location produced in accordance with the invention of the instant application is also purely externally or superficially barely able to be distinguished from an undisrupted thread.

As is especially shown in FIGS. 6 and 7, the splicing chamber 30 has a controllable sliding cover 40. The thread severing devices 32 and 33 are formed as cutting members and disposed directly on the sliding cover 40. Each cutting member has two scissor blades. Thus, for example, the cutting member 32 has a scissor blade 80 fixed to or arrested with the sliding cover 40, and a controllable scissor blade 82. The thread severing device 33 has a scissor blade 81 fixed to or arrested with the sliding cover 40 and a controllable scissor blade 83. The scissor blades 80 to 83 are connected by a pin 84 to the sliding cover 40. A set pin or adjusting pin 85 arrests the two scissor blades 80 and 81. The controllable scissor blades 82 and 83 are controlled in common. The details of the control are described hereinbelow. The control is effected so that when the sliding cover 40 is open, as shown especially in FIG. 7, the scissor blades 80 to 83 are disposed adjacent the elongated slot 37 of the splicing chamber 30 and so that when the sliding cover 40 is closed, both controllable scissor blades 82 and 83 are slid between the inserted threads 12 and 13.

It is especially evident from FIG. 5 that the threads are introduced into the splicing chamber 30 in a manner that they rest against the bottom of the splicing chamber at the side from which they come, and extend out of the splicing chamber in vicinity of the sliding cover at the opposite side. As shown especially in FIG. 4, the respective scissor blade 82 or 83 is slid between the upper and the lower threads so that, during the splicing, only little air can escape from the splicing chamber 30 along the on-running upper and lower threads 12 and 13, respectively. In this regard, in no case, can the spliced thread be severed by accident instead of the thread end.

Figure 3:
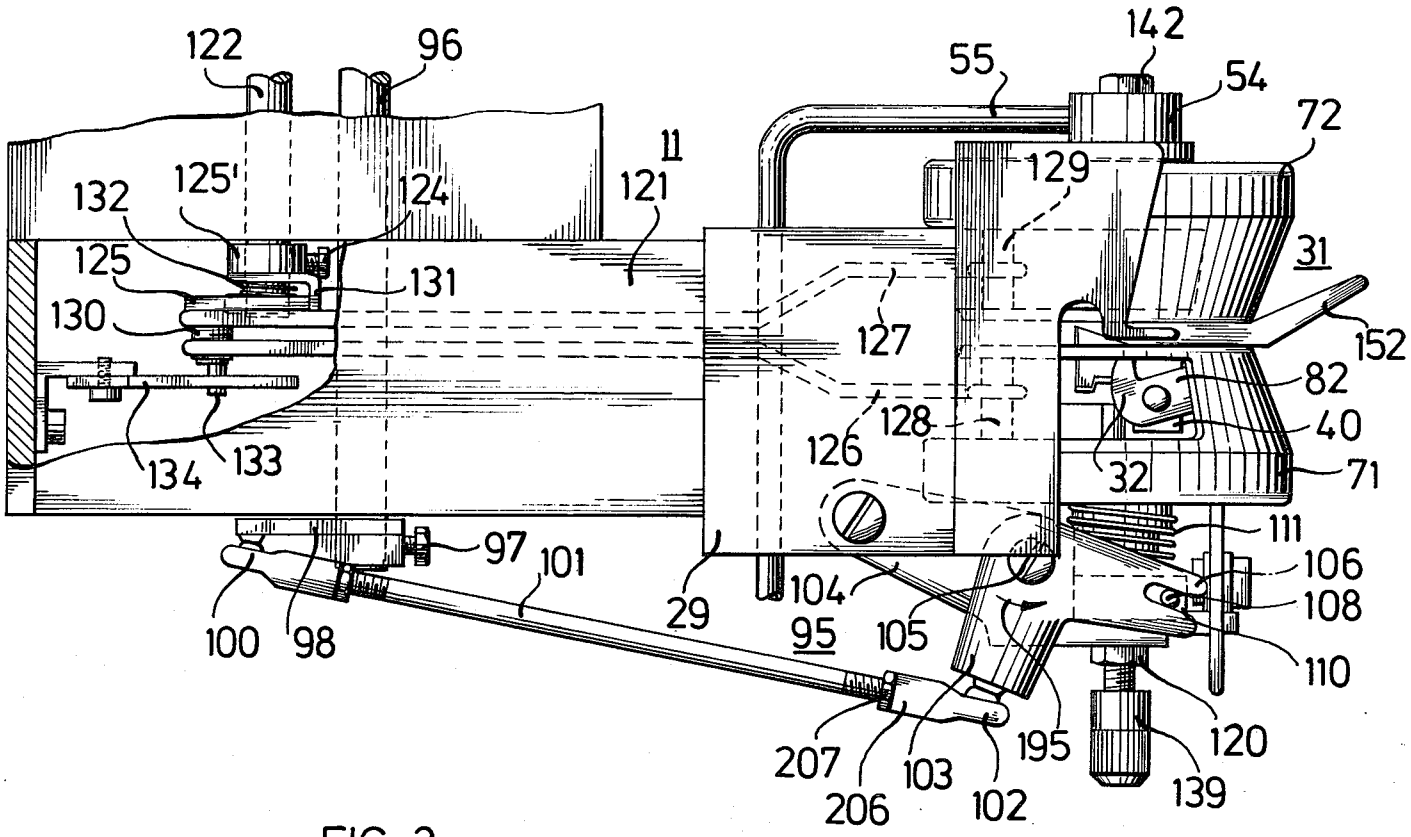
FIG. 3 is a fragmentary top plan view of FIG. 2 rotated counterclockwise through 90°.

FIGS. 3, 5 and 7 show that the splicing chamber 30 and the housing 46 thereof have a holding device extending transversely to the travel direction of the thread. According to FIG. 7, this holding device is formed of two cylindrical hollow members 87 and 88 having a common longitudinal axis 86. The hollow member 87 serves simultaneously as guidance tube for a threaded spindle 89 of a fine adjustment device 90 which will be discussed in further detail hereinbelow. The other hollow member 88 serves simultaneously as compressed-air supply for the splicing chamber 30.

The one half 72 of the thread twist changing member 31 is rotatably disposed above the hollow member 88 firmly connected to the housing 46. Moreover, the half 72 is provided with a bearing bushing 91. The other half 71 of the thread twist changing member 31 is rotatable and simultaneously slidably disposed above the other hollow member 87.

Between the hollow member 87 simultaneously serving as a guidance tube and the half 71 of the thread twist changing member 31, a sliding sleeve 92 is disposed which carries the sliding cover 40. In order to ensure the slidability of the foregoing parts, the sliding sleeve 92 carries a bearing bushing 92, and the half 71 carries a bearing bushing 94.

It is especially apparent from FIG. 3 that the thread twist changing member 31, with respect to the axial displacement of the halves thereof, the sliding cover 40 and the thread severing members 32 and 33 have a common actuating device identified as a whole by reference numeral 95. The actuating device 95 is formed of the following parts and operates as follows:

A pivotable shaft 96 is turnable by an otherwise non-illustrated cam disc and a control transmission, respectively, so that a lever 98 fastened on the shaft 96 by means of a screw 97 can be swung or pivoted in direction of the arrow 99 (FIG. 4) and back. A universal or ball-and-socket joint 100 connects the lever 98 to a rod 101. At the end of the rod 101, a threaded sleeve 206 is seated, with the air of which the length of the rod 101 is adjustable. The chosen adjusted length is fixed by a lock nut 207. Another universal joint 102 connects the threaded sleeve or bushing 206 to a bellcrank or angle-lever bridge 103 which is mounted so as to be pivotable about an axis 105 on an arm 104 extending from the housing 29. It is especially evident from FIGS. 2 and 3 that fork-like ends 106 and 107 of the bellcrank bridge 103 embrace two entrainer pins 108 and 109 of a guide shoe or block 110. The guide block 110, which is also visible in FIG. 7, is screwed to the sliding sleeve or bushing 92. A helical spring 111 is braced at one end thereof against the half 71 of the thread twist changing member 31. Whereas the guide block 110 is connected by two screws 112 and 113 to the sliding sleeve 92, a non-releasable connection exists between the sliding cover 40 and the sliding sleeve 92, as is shown, especially in FIG. 6 of the drawing.

The parts actuated in common by the actuating device 95 are adjusted by preventer or hold-back mechanisms to various courses of movement or travel. With the pivoting of the lever 98, the sliding sleeve 92 as well as the sliding cover 40 therewith is directly moved initially in direction of the longitudinal axis 86 by means of the longitudinally adjustable rod 101. Because, however, as shown in FIG. 7, the half 71, on the one hand, rests against the sliding cover 40 and, on the other hand, is loaded or stressed by the helical spring 111, the half 71 is also entrained parallel to the direction of the arrow 114 with a displacement of the sliding sleeve 92 until the friction surface 73 thereof comes into engagement either with the inserted threads and, accordingly, with the adjacent friction surface 74 or, when no threads are inserted, directly with the edge 115 of the housing 46. If the sliding sleeve 92 is then slid forward farther, a further compression of the helical spring 111 occurs, while the half 71 does not further change the position thereof. In this case, both the edge 115 as well as the helical spring 111 serve as preventer or hold-back devices for the half 71.

Figure 9:
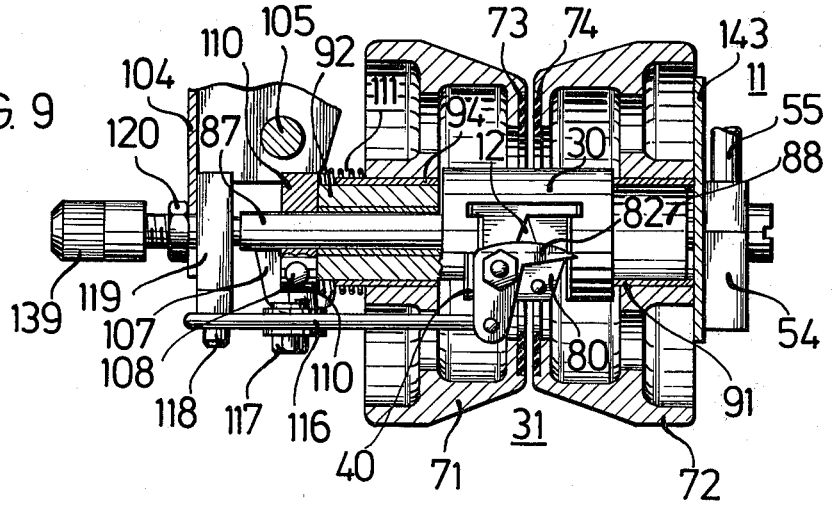

The hold-back device for the controllable scissor blades 82 and 83 of the thread severing devices 32 and 33 is formed of a wire yoke 116, an adjustable clamping screw 117 and a hammerhead 118 of a fishplate or strap 119. The fishplate 119 is fastened in common with the guide tube 87 by means of a nut 120 to the arm 104 of the housing 29. The wire yoke 116 is suspended behind the hammerhead 118. The angularly bentaway ends of the wire yoke 116 are articulatingly connected to the two controllable scissor blades 82 and 84, as is also clearly apparent from FIG. 6. In the starting position, the thread severing devices 32 and 33 are open as shown in FIG. 7. The extent of the opening of the scissors of the thread severing devices 32 and 33 is determined by the position or setting of the adjustable clamping screw or setscrew 117. If the sliding sleeve 92 is then shifted parallel to the direction of the arrow 114, the wire yoke 116 thus travels therewith initially in the same direction and there is no change in the setting of the scissors. In the phase of operation shown in FIG. 8, the end of the wire yoke 116 has reached the hammerhead 118 so that, upon further shifting of the sliding sleeve 92, the wire yoke 116 is held back with consequent closing of the scissors-like thread severing devices, as shown in FIG. 9.

The embodiments described heretofore reveal that the splicing chamber 30, the thread twist changing or varying member 31 and the thread severing devices 32 and 33 have a common housing 29 which also carries a part of the actuating device 95 as well as the actuating device 121, which will be described in greater detail hereinafter, and that the remaining part of the actuating devices 95 and 121 has a separate and special housing 36 fastened to the machine frame 14. Both the two housings 29 and 36 as well as the elements of the actuating devices associated with the housings are constructed so as to be couplable to one another. The disassemblability of the housing 29 has been mentioned hereinbefore. The rod or bar 101 of the actuating device 95 is uncouplable since the two universal joints 100 and 102 are constructed as attachable universal joints.

Figure 4:
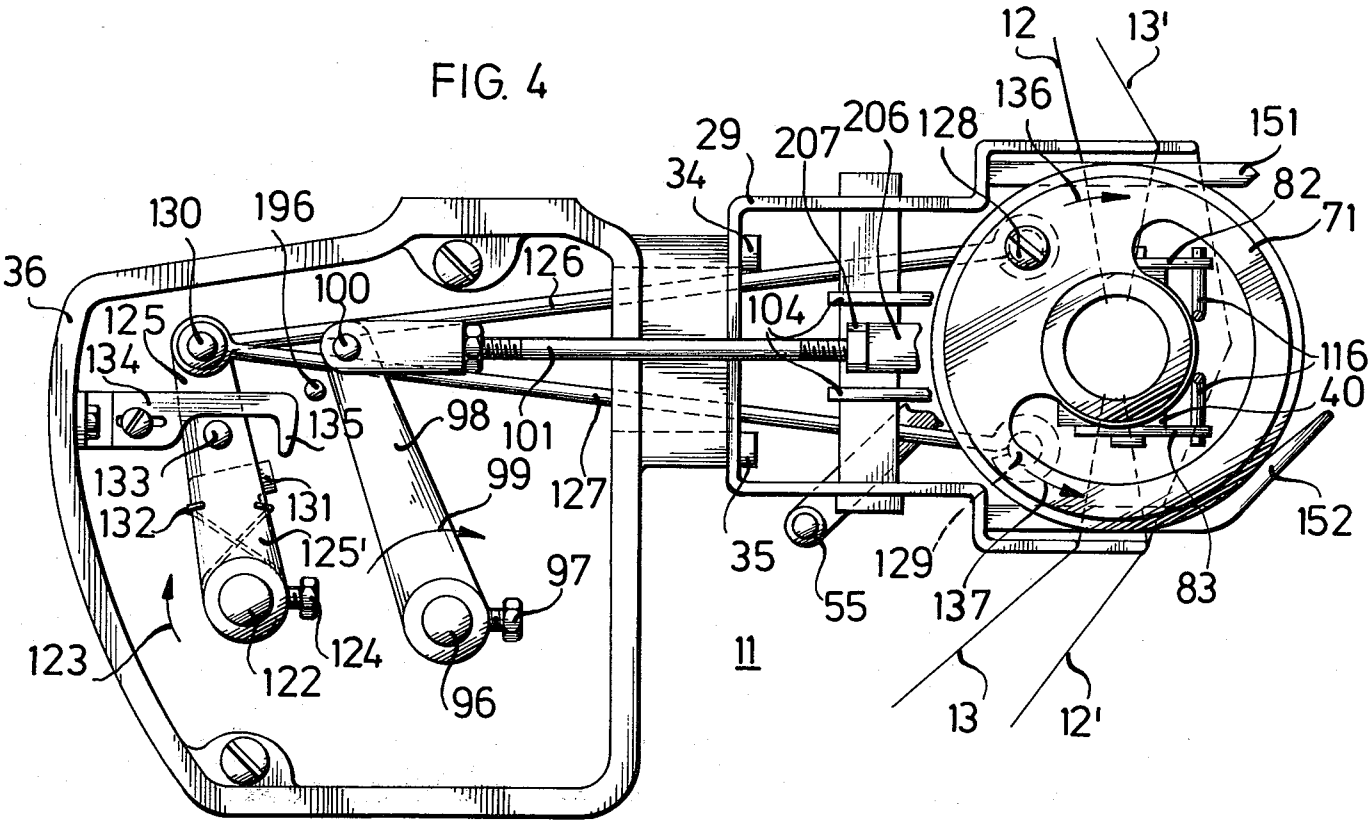
FIG. 4 is an enlarged fragmentary view of FIG. 1, in partly disassembled condition.

The second actuating device 121 which is responsible for the opposite rotation of the two halves 71 and 72 of the thread-twist changing member 31 is formed of the following parts:

As shown especially in FIGS. 3 and 4, a shaft 122 is pivotable by an otherwise non-illustrated cam disc and a control transmission, respectively, in direction of the arrow 123 and in opposite direction to the arrow 123. A lever 125 is pivotable together with the shaft 122. At the end of the lever 125, two rods 126 and 127 are articulatingly suspended. The rod or bar 126 is connected to a crank pin 128 which is fastened to the half 71. The lever 127 is connected to another crank pin 129 which is fastened to the other half 72 of the thread-twist changing member 31. The disassemblability of the rods 126 and 127 is provided by the fact that the suspension point at the lever 125 is realized by a screw connection 130.

The angle of rotation of both halves 71 and 72 of the thread-twist changing member 31 is adjustable in the following manner:

A short lever 125' is connected by a screw 124 to the shaft 122 and has a stop or butt strap 131 for a longer lever 125 which is likewise stuck onto the shaft 122, however, without being connected to the shaft 122. The lever 125 is held in engagement with the butt strap 131 by means of a wound spiral spring 132. The lever 125 has a stop pin 133. An adjustable fishplate 134 is fastened to the housing 36 and has a stop nose 135. The movement of the lever 125 in direction of the arrow 123 is limited to that angle of rotation which results if the stop pin 133 comes into engagement with the stop nose 135.

The direction of rotation of both halves 71 and 72 of the thread-twist changing member 31 is adjustable in the following manner:

According to FIG. 4, the crank pin 128 is moved in direction of the arrow 136 and the crank pin 129 in direction of the arrow 137 is the lever 125 swings in direction of the arrow 123. The direction of rotation of both halves 71 and 72 of the thread-twist changing member 31 is thereby determined. If this direction of rotation is to be varied, the screw connection 130 is thus initially loosened. Then, both halves 71 and 72 can be rotated so far that the crank pin 129 lies above while the crank pin 128 lies below i.e. exactly opposite to the locations thereof in FIG. 4. Thereafter, both rods 126 and 127 are again fastened to the lever 125. If the lever 125 then swings in direction of the arrow 123, the crank pin 129 thereupon moves in direction of the arrow 136 and the crank pin 128 in direction of the arrow 137 i.e. in the opposite direction than before. The two halves 71 and 72 are also moved opposite one another. The changeover form S-twisted threads to Z-twisted threads is thus to be performed with minimal manipulations.

FIG. 7 when taken together with FIG. 6 shows that the adjustable side wall 41 of the splicing chamber 30 has a fine adjustment device identified as a whole by reference numeral 90 in FIG. 7. The fine adjustment device 90 is formed, according to FIGS. 6 and 7, of the following parts:

(a) the threaded spindle 89, engaging in a female thread 136 formed in the adjustable side wall 41, (b) a locally stationary guidance tube 87 for the threaded spindle 89, the guidance tube 87 being provided with an external thread 137, and (c) an adjusting knob 139 connected to the threaded spindle 89 by means of a setscrew or adjusting screw 138, the adjusting knob 139 has a female thread 140 engaging in the external thread 137 of the guidance tube 87.

The pitch of the spindle thread 141 deviates from the pitch of the guidance tube thread 137. In the embodiment at hand, the pitch of the spindle thread 141 is smaller than the pitch of the guidance tube thread. In both cases, a right-hand thread is involved. If the adjusting knob 139 is turned clockwise, the side wall 41 is displaced.

FIGS. 6 and 7 also disclose the following details of the device according to the invention:

The compressed air supply channel 38 of the housing 46 terminates in a compressed air junction 54 which is fastened by a screw 142 to the hollow member 88 so that both parts are simultaneously connected to a side wall 143 of the housing 29. The compressed air junction 54 has an insert or plug-in tube 144 which fits into the compressed air supply channel 38. The plug-in tube 144 secures the compressed air junction 54 simultaneously against turning or twisting. The hollow member 88 has a special protection against turning or twisting which is in the form of a set or adjusting pin 145, which fits into a bore 146 formed in the side wall 143. FIGS. 2, 6 and 7 further show that the basket-like or pot-like halves 71 and 72 of the thread-twist changing member 31 are formed at the side and at the bottom thereof with recesses for the required actuating means. Thus, for example, in the half 71 in FIG. 2, there is shown the recess 147 for the crank pin 128 and the rod 126 and, in FIG. 7, the recess 148 for the wire yoke 116. In the other half 72, there is shown in FIG. 2 the recess 149 for the crank pin 129 and the rod 127 and, in FIG. 7, a semicircular recess 150.

In FIGS. 1 and 2, there are additionally illustrated threading aids 151 and 152 in the form of pins on the housing 29. FIG. 2 shows, in addition, a respective alternative controllable thread clamping device 153 or 154 for the upper thread 12 or the lower thread 13, respectively.

With regard to a second embodiment of the invention, there is shown in FIGS. 10 and 11 a thread-twist changing member identified as a whole by the reference numeral 155. This thread-twist changing member 155 has rollers united into roller groups 156 and 157, the rollers being rotatable in the same rotary sense and being close to one another a distance less than the thread diameter. Both roller groups 156 and 157 are disposed above one another at a short distance from a splicing chamber 158. The roller group 156 is formed of tapered rollers 159, 160 and 161, and the roller group 157 of tapered rollers 162, 163 and 164.

All of the tapered rollers are of the same construction as, for example, the tapered roller 160 shown in FIG. 11. In FIG. 11, there is further illustrated a frame 165 with a pipe union 167 carrying a bearing 166 for the tapered roller 160. At the rear end of the pipe union or stub 167, a hose connection 168 is located leading to an otherwise non-illustrated suction air supply device. The tapered roller 160 is constructed as a hollow member like the other tapered rollers. The conical or tapered inner wall 170 supports the tapered roller 160 at the tip thereof and is formed with a slot 171. A ring channel 172 formed as an air manifold channel is located between the outer and the inner walls. The tapered end 173 of the tapered roller 160 points towards the splicing chamber 158. The other end of the tapered roller 160 carries a bevel gear 174. The bevel gears of all of the tapered rollers 160, respectively, are similar and mesh with a ring gear 175 common to all of the bevel gears 174. The surface 176 of the roller 160 is a friction surface.

FIG. 10 of the drawing shows a further frame 177 for the roller group 157. In addition, further details which are identical to those of the first-described embodiment are apparent in the embodiment of FIG. 10, namely a cop or supply coil 20, thread delivery and holding members 58 and 62, a take-up coil 25 and controllable thread clamps 153 and 154. It is also apparent from FIG. 10 that the upper thread 12, as well as the lower thread 13, is guided rectilinearly through the thread-twist changing device 155.

Figure 12:
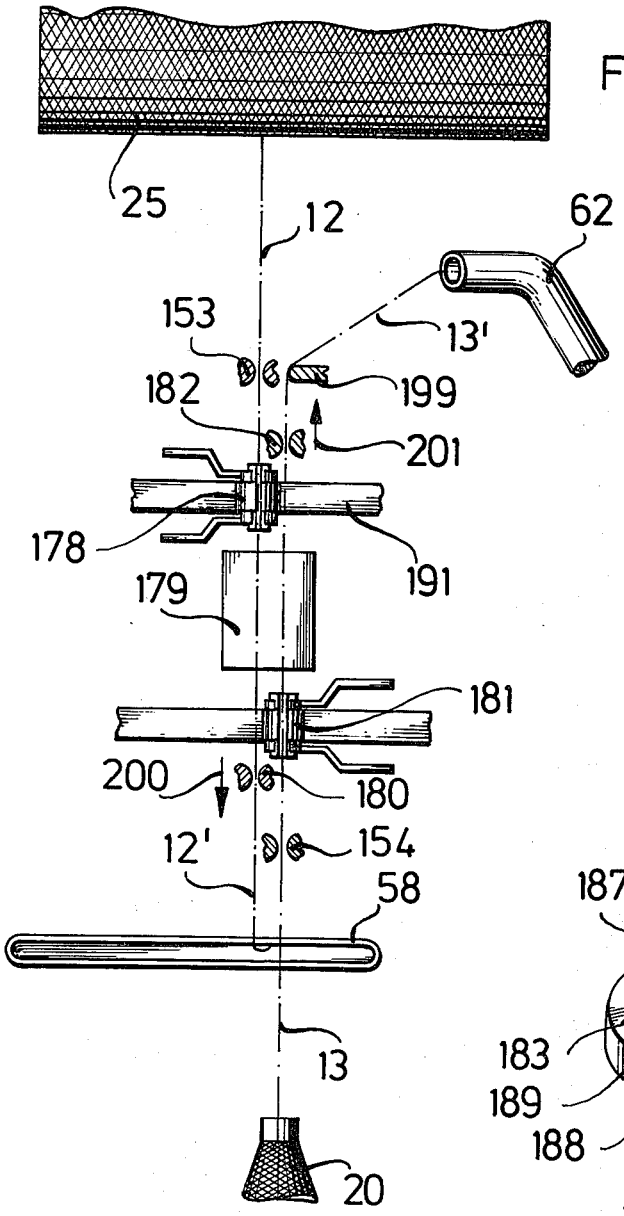
FIG. 12 is a diagrammatic view of another embodiment of the invention.
Figure 13:
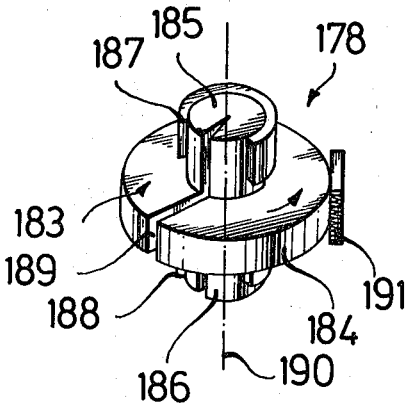
FIG. 13 is an enlarged fragmentary perspective view of FIG. 12 showing a turning clip of this additional embodiment of the invention.

A further embodiment of the invention is diagrammatically illustrated in FIG. 12. FIG. 13 shows a detail thereof in an enlarged view. The elements of the embodiment of FIGS. 12 and 13 which are similar to those of the aforedescribed embodiments are the supply coil 20, the take-up coil 25, the thread delivery and holding members 58 and 62 as well as the controllable thread clamps 153 and 154. The upper thread 12 lies in the controllable thread clamp 153, in a thread-twist changing device 178, in a splicing chamber 179 and in a controllable traveling clamp 180, while the thread end 12' projects into the thread delivery and holding member 58. The lower thread 13 lies in the controllable thread clamping device 154, in a thread-twist changing device 181, in the splicing chamber 179 and in another traveling clamp 182, while the thread end 13' thereof projects into the thread delivery and holding member 62. In this embodiment of FIG. 12, a thread-twist changing device 178 or 181, respectively, is provided for each thread 12 and 13. Both thread-twist changing devices 178 and 181 are of like construction and, for example, are duplicates of the thread-twist changing member or device 178 as shown more clearly in FIG. 13.

It is apparent from FIG. 13, that the thread-twist changing device 178 has a rotatable thread holding member 183. The thread holding member 183 is constructed as a rotary member with a middle part 184 and two end parts 185 and 186 which are rotatably mounted in respective bearing boxes or bushings 187 or 188. In addition, FIG. 13 shows a thread clamping slot 189 which extends radially to the middle i.e. longitudinal, axis 190. The rotating drive of the thread-twist hanging device 178 of FIG. 13 is effected by a tangential belt 191.

Figure 14:
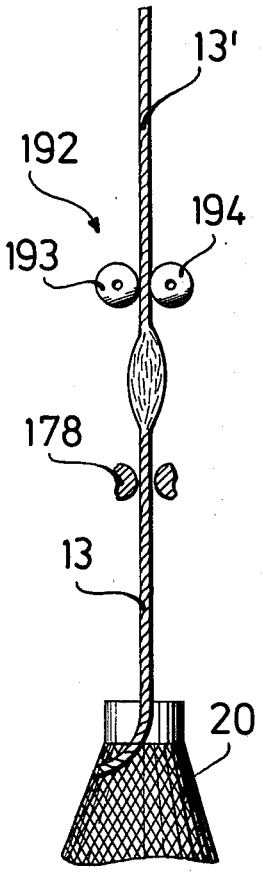
FIGS. 14 and 15 are digrammatic views of part of a fourth embodiment of the invention in different phases of unraveling a thread end.
Figure 15:
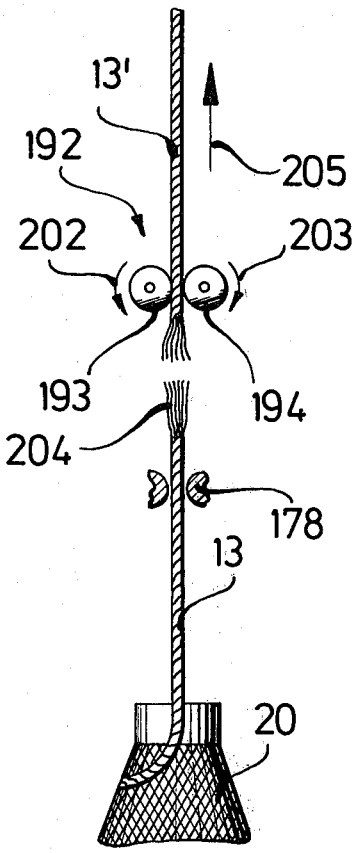

In a final described embodiment of the invention there is indicated with respect to FIGS. 14 and 15 in what manner the threads can be freed of the excess thread ends thereof either before or after the splicing operation by means of unraveling. Shown in FIGS. 14 and 15 are the supply coil 20, a diagrammatic representation of the thread-twist changing device 178 shown in greater detail in FIG. 13, and a thread unraveling device 192 formed of a roller pair 193, 194. FIG. 14 shows the lower thread 13 with the thread end 13' not yet unraveled while, in FIG. 15, the thread end 13' of the lower thread 13 is shown already unraveled.

The operation of each of the aforedescribed embodiments of the invention follows:

In the first embodiment of the invention shown in FIGS. 1 to 9, it is initially assumed that, at the winding station 19, the thread previously extending along the line 28 is broken. An upper thread 12 and a lower thread 13 have accordingly been formed thereby. The upper thread 12 is taken up by the take-up coil 25, and the lower thread 13 held fast by the thread brake 23 in connection with the computer or calculator sensor 22.

The break in the thread is determined in a conventional, non-illustrated manner, and the device 11 accordingly informed thereof. As shown in FIG. 1, the device 11 travels on the support tube 18 in front of the winding station 19. The thread delivery and holding members 58 and 62 are in rest or inactive position thereof which is identical to the thread delivering position thereof represented in solid lines in FIG. 1, ignoring the previous location of the threads indicated therein.

The device 11 then acts in the following manner:

In the machine frame 14, there is located an otherwise non-illustrated control transmission which starts or becomes operative in response to a signal automatically initiated by the winding station 19 and turns the swivel joint 60 of the thread delivery and holding member 58 in direction of the arrow 195, until the thread delivery and holding member 58 reaches the thread take-up position 58*a*. In the latter position, the suction slit nozzle 61 is located closely in front of the surface of the take-up coil 25. The suction slit nozzle 61 extends over the entire breadth i.e. length, of the take-up coil 25. Due to the negative pressure or suction acting at the suction slit nozzle 61, as the take-up coil 25 slowly rotates, the thread end 12' of the upper thread 12 is sought out, sucked-in and held fast.

Simultaneously, the control transmission turns the swivel joint 63 of the thread delivery and holding member 62 in direction of the arrow 67, until the thread delivery and holding member 62 has reached the thread take-up position 62*a*. The clamping cover 66 drives against the stop 68 thereat and accordingly opens. The suction nozzle 65 can then suck in and hold the thread end 13' of the lower thread 13. After a closely adjusted, brief reaction period, the control transmission turns both swivel joints 60 and 63 back to the starting position. The two thread delivery and holding members 58 and 62 accordingly swing simultaneously into the thread delivery positions represented in FIG. 1. While the thread delivery and holding member 62 swings back, the clamping cover 66 closes again and, accordingly, holds the thread end 13' in clamped condition.

In the interim, the splicing chamber 30 is opened as well as the thread-twist changing member 31, also. The thread location represented in FIGS. 1, 2 and 5 is produced. The upper thread 12 coming from the take-up coil 25 lies against the thread guidance means 75, extends along the left-hand side of the threading aid 151, passes through the elongated slot 37 of the splicing chamber 30 and is disposed radially between the friction surfaces 73 and 74 of the two halves 71 and 72 of the thread-twist changing device 31, is guided along the left-hand side of the threading aid 152, engages the thread guidance means 78 and, with the thread end 12' thereof, projects into the suction slit nozzle 61 of the thread delivery and holding member 58. The lower thread 13, coming via the thread guide 21 from the supply coil 20, is inserted into the computer or calculator sensor 22, the thread brake 23 and the thread guide 24, guided over the rear side of the suction slit nozzle of the thread delivery and holding member 58, engages the thread guidance means 77, is guided along the right-hand side of the threading aid 152, passes radially by the two friction surfaces 73 and 74 of the two halves 71 and 72, respectively, of the thread-twist changing device 31, is inserted into the elongated slot 37 of the splicing chamber 30 wherein it crosses the upper thread 12, is guided along the right-hand side of the threading aid 151, engages the thread guidance means 76 and is clamped by the thread end 13' thereof between the edge of the suction nozzle 65 and the clamping cover 66 of the thread delivery and holding member 62.

Should the aforementioned thread holding means be insufficient for some reason or other, to give the threads the required thread tension, the controllable thread clamping devices 153 and 154 represented in FIG. 2 can be disposed alternatively. The thread clamping devices 153 and 154 will then remain open until that instant.

FIG. 7 shows the positio of the sliding cover 40 and the thread severing device 32 after the insertion of the thread 12 and 13 into the splicing chamber 30.

With special reference to FIGS. 3, 4, 7, 8 and 9, the preparation, performance and termination of the splicing operation per se is explained hereinafter.

The control transmission previously mentioned, though not especially illustrated in the figures, sets the two shafts 96 and 122 successively in motion, by means of cam-discs, in direction of the arrows 99 and 123, respectively. First, the shaft 96 is rotated. The lever 98, accordingly, moves the rod 101 forwardly, whereby the bellcrank bridge 103 is swung in direction of the arrow 195. The fork-like ends 106 and 107 thereof entrain the entrainer pins 108 and 109 so that the guide block 110 is forced to travel farther, parallel to the direction of the arrow 114 (FIG. 7) on the guide tube 87 and, in fact, above all, until the phase or position represented in FIG. 8. Because the guide block 110 is connected to the bearing bushing 92, the sliding cover 40 which is also connected to the bearing bushing 92 is likewise displaced parallel to the direction of the arrow 114 until it has reached the position represented in FIG. 8. The friction surfaces 73 and 74 of the halves 71 and 72 then engage the threads 12 and 13. The splicing chamber 30 is closed. The rear end of the wire yoke 116 has reached the hammerhead 118. The controllable scissor blade 82 of the thread severing device 32 and also the controllable scissor blade 83 of the thread severing device 33 has been shifted with the point thereof between the threads 12 and 13.

Then, in accordance with a control program, the shaft 122 is set in motion. The shaft 122 is rotated in direction of the arrow 123, together with the lever 125' as well as with the lever 125 resiliently or springily connected to the lever 125'. Both rods 126 and 127 (FIG. 4) are thus shifted forwardly so that the crankpin 128 and the half 71, accordingly, are rotated in direction of the arrow 136, and the crank pin 129 and, accordingly the half 72 are rotated in direction of the arrow 137.

If FIG. 5 is then considered, the friction surface 74 of the half 72 of the thread-twist changing member 31 is noted. The rotary direction is indicated here by the arrow 79. The friction surface 73 not shown in FIG. 5 rotates opposite to the friction surface 74 which is illustrated in FIG. 5. The threads 12 and 13 clamped between the friction surfaces 73 and 74 are thus rotated about the longitudinal axes thereof so that, in a desired manner, as shown in FIG. 5, a loosening of the thread twist in the region disposed in the splicing chamber occurs. Outside or beyond the friction surfaces 73 and 74, the twist pile-up or accumulation is likewise represented in FIG. 5.

At the end of the pivoting movement of the shaft 122, the lever 125 comes in front of a proximity switch 196 which switches on the compressed-air metering valve 56 shown in FIG. 2. The blast or blowing pressure and the blast or blowing time have been set beforehand at adjusting knobs 197 and 198, respectively. After the compressed-air metering valve 56 has been turned on, the compressed air flows through the pipeline 55, the compressed-air junction 54, the plug-in tube 144, the compressed-air supply channel 38 and the bottom opening 39 into the elongated slot 37 of the splicing chamber 30. Under the action of the compressed air, the threads become spliced to one another.

The length of the splicing location is exactly defined and prescribed, which constitutes a significant advantage of the invention. The length of the splicing location is equal to the length of the elongated slot 37. Because both controllable scissor blades 82 and 83 with the points thereof have been slipped between the threads, the splicing location cannot go out over the length of the elongated slot 37. Because the splicing air must escape to both sides out of the splicing chamber, the device according to the invention ensures that the air escapes essentially along the thread ends to be subsequently severed, where the air can no longer impair the threads themselves which are to be spliced.

The reaction time of the compressed air is normally only very brief. After expiration of the reaction time, the control transmission ensures that the lever 98 will turn somewhat farther in direction of the arrow 99. The slide block 110 accordingly reaches the position thereof illustrated in FIG. 9. Both the guide sleeve 92 as well as the slide cover 40 join in this movement and, likewise, the scissor blades 80 and 81 arrested or secured on the slide cover 40. The half 71, on the other hand, cannot join in this movement because it already engages the threads 12 and 13 and thus, indirectly, also the half 72, under the pressure of the spring 111. The half 71 as well as the half 72 remains in its position under further compression of the spring 111. The wire yoke 116 is held back by the hammerhead 118. A consequence thereof is that the thread severing devices 32 and 33 close as, for example, the thread severing device 32 shown in FIG. 9. Be means of this operation, the thread ends 12' and 13' become severed and, by means of the thread delivery and holding members 58 and 62 are held fast and sucked away, respectively.

Then, the aforementioned control transmission causes the reverse turning of the levers 98 and 125 and 125', respectively, to the starting positions thereof shown in FIG. 4. This occurs in a manner wherein the lever 125 attains the starting position thereof at the instant in which the guide block 110 first assumes the position thereof shown in FIG. 8. Assurance is thereby provided that the splicing location receives a thread twist while the farther outer located twist build-up or accumulation again unravels or loosens. When the aforementioned levers 98, 125, 125' reach the starting position thereof, the splicing chamber 30 is opened. When winding tension is reinstituted, the spliced thread snaps or bounces out of the splicing chamber 30, slides laterally off the rounded back of the suction slit nozzle 61, and then assumes the thread position or course identified by reference numeral 28 in FIG. 1. The activity of the device 11 is then ended and it can travel farther on to a different work location. The winding station 19 can reassume the normal operation thereof.

The basic concept of the first embodiment of the invention need not be altered if a thread-twist changing member 150, such as is shown in FIGS. 10 and 11, is installed. Also, in the thus resulting second embodiment of the invention, both thread delivery and holding members 58 and 62 are provided which insert the threads 12 and 13 into the splicing chamber 158. The upper thread 12, coming from the take-up coil, is introduced into the initially yet open thread clamping device 153, guided between the tapered rollers 159 and 160 of the roller group 156, placed into the splicing chamber 158, guided between the tapered rollers 162 and 163 of the roller group 157, and held at the thread end 12' thereof by the thread delivery and holding member 58. The lower thread 13, coming from the supply cop 20, is inserted into the initially yet open controllable clamping or gripping device 154, guided between the tapered rollers 163 and 164 of the roller group 157, placed in the splicing chamber 158, guided between the tapered rollers 160 and 161 of the roller group 156, and finally held at the thread end 13' thereof by the thread delivery and holding member 62.

After the splicing chamber 158 and the thread clamping devices 153 and 154 have been closed, the ring gear 175, in the case of S-twisted threads, is rotated in direction of the arrow 198 until the desired extent of loosening or unraveling of the thread twist has been attained. A twist pile-up or accumulation also thereby occurs in the threads, outside or beyond the thread-twist changing member 155. Thereafter, the splicing operation takes place in the manner explained hereinbefore with respect to the first embodiment of the invention, whereupon the ring gear 175 is again turned back a specific extent. The reverse rotation path can be somewhat greater, with the objective of imparting an increased thread twist to the completed splicing location. After the splicing operation and, if necessary even before reverse rotation of the ring gear 175, the thread ends 12' and 13' are broken due to increased tension applied by the thread delivery and holding members 58 and 62. After the thread clamping devices 153 and 154 have opened and after the splicing chamber has opened, the activity of the thread-twist changing device 155 as well as that of the entire splicing device, also, is terminated. During the aforedescribed operations, suction air acts through the hose junctions 168 on the individual tapered rollers so that the threads remain in the prescribed position thereof between the taperd rollers during the activity of the thread-twist changing device 155.

In the third embodiment of the invention as shown in FIGS. 12 and 13, the take-up coil 25, the supply cop 20, the thread clamping devices 153 and 154 and the thread delivery and holding members 58 and 62 are again noted.

The upper thread 12 comes from the take-up coil 25, is guided through the opened thread clamping device 153 and through a thread-twist changing device 178, lies in the splicing chamber 179 and in an opened traveling clamp 180. The thread end 12' thereof is held by the thread delivery and holding member 58. The lower thread 13 coming from the supply cop 20 lies in the opened thread clamping device 154, is placed into a thread-twist changing device 181 and into the splicing chamber 179, is disposed, in addition, in a traveling clamp 182, is diverted from the position thereof at the thread deflecting location 199, and is held at the thread end 13' thereof by the thread delivery and holding member 62.

Before the insertion of the threads with the aid of the thread delivery and holding members 58 and 62, the thread clamping slits 189 of the two thread-twist changing devices 178 and 181 are disposed towards the front so that the threads can be inserted without constraint. Then, the thread clamping or gripping devices 153 and 154 as well as the traveling clamps or grippers 180 and 182 are closed and the two thread-twist changing devices 178 and 181 are set into rotation by tangential belts 191 and 191'. The direction of rotation again depends upon the type of thread twist. Finally, the upper thread 12 is freed of the thread twist thereof in the region between the thread-twist changing device 178 and the traveling gripper 180, and the lower thread 13 in the region between the thread-twist changing device 181 and the traveling gripper 182.

Distinguished from the foregoing embodiments of the invention, the thread ends 12' and 13', in the third embodiment of FIGS. 12 and 13 are removed by picking or plucking even before the splicing operation. This occurs by the traveling gripper 180 being displaced parallel to the direction of the arrow 200 and the traveling gripper 182 parallel to the direction of the arrow 201. After the picking or plucking of the thread ends 12' and 13', the splicing operation occurs, whereupon both thread-twist changing devices 178 and 181 are again rotated back to the starting position thereof. If the thread gripper slit 189 finally lies to the front when the thread-twist changing devices are not operating, the spliced thread can bounce or be impelled frontwards out of the splicing device, if the winding tension is reinstituted.

A fourth embodiment of the invention shown in FIGS. 14 and 15 is limited to an alternative possibility for picking or plucking the thread ends. The supply cop 20 from which the lower thread 13 originates is readily recognizable in FIGS. 14 and 15. The lower thread 13 is placed into the thread-twist changing device 178 constructed in accordance with that of FIG. 13. Thereabove is located the thread picking or plucking device 192 which is formed of the roller pair 193 and 194. Both rollers engage the thread 13 with slight clamping or gripping force. The thread end 13' extends to a further non-illustrated thread delivery and holding member.

In the last-mentioned embodiment, the thread 13 is already freed of the thread twist thereof in the region between the thread-twist changing device 178 and the thread picking or plucking device 192.

The activity of picking or plucking of the thread end 13' is illustrated in FIG. 15. The roller pair 193, 194 is set into rotation there in direction of the arrows 202 and 203, respectively. This results in the picking or plucking of the thread end 13' in the region between the thread-twist changing device 178, which also grips or clamps the thread 13 amongst others, and the thread picking or plucking device 192. The lower thread 13 remains with a fiber beard 204, the thread end 13' is sucked away parallel to the direction of the arrow 205.

Figure 16:
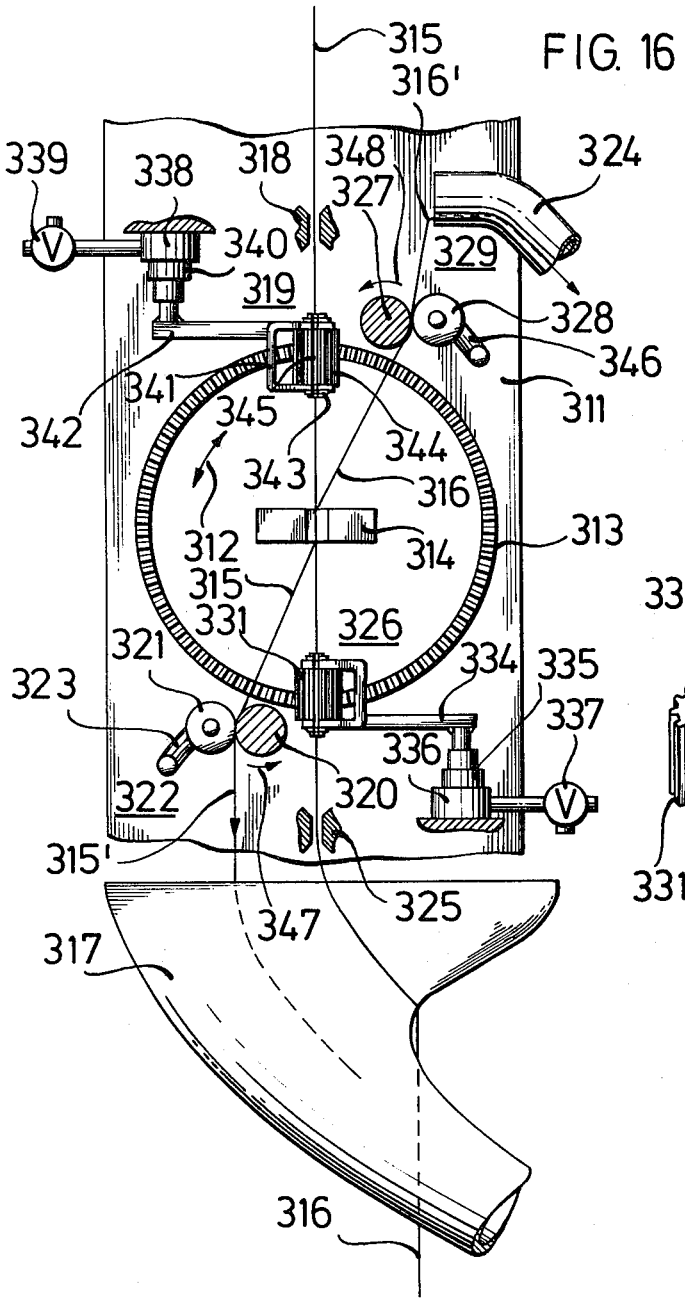
FIG. 16 is a diagrammatic view of a fifth embodiment of the invention.
Figure 17:
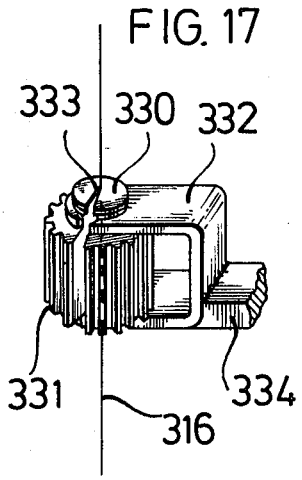
FIG. 17 is a fragmentary enlarged perspective view of FIG. 16 showing a detail thereof.

In FIGS. 16 and 17, as mentioned hereinbefore, a fifth embodiment of the invention is diagrammatically illustrated.

A base plate 311 carries a ring gear 313 rotatable in direction of the double-headed arrow 312, a splicing chamber 314 being located at the center axis of the ring gear 313. An upper thread 315 coming from above is to be connected, in the splicing chamber 314, with a lower thread 315 coming from below. For this purpose, the upper thread 315 has already been inserted by means of an automatic thread inserter 317 into a thread clamp or gripper 318, a thread-twist changing device 319, into the splicing chamber 314 and between the rollers 320 and 321 of a thread picking or plucking device 322. The roller 320 is drivable and mounted in bearings on the base plate 311.

The roller 321 is held by a pivot arm 323 and can be placed against the roller 320 or lifted therefrom.

In the same manner, the lower thread 316 is inserted by a thread inserter 324 into a thread gripper 325, a thread-twist changing device 326, the splicing chamber 314 and between the rollers 327 and 328 of a thread picking or plucking device 329.

The roller 327 is drivable and mounted on the base plate 311. The roller 328 is held by a pivot arm 346 and can be placed against the roller 327 or lifted therefrom.

The thread-twist changing device 326 is shown in a perspective view in FIG. 17. It has a thread holding member 330 provided with a gear 331 of elongated shape which meshes with the ring gear 313. The thread holding member 330 is held by a bearing yoke 332. The lower thread is held in the thread holding member 330 by being clamped in the apex of a V-shaped slit 333. The slit 333 also extends through a tooth gap of the gear 331 and through the bearing yoke 332. If the gear 331 is in the position thereof shown in FIG. 16, there is then no difficulty in inserting or removing the thread from the thread-twist changing device 326.

The bearing yoke 332 is connected by a strap 334 to the end of a telescopic tube 335 belonging to a shifting or displacing device 336. The shifting device 336 has a control valve 337.

If the control valve 337 is subjected to compressed air, the thread-twist changing device 326 is displaced in direction towards the splicing chamber and, if the control valve 337 is subjected to suction air, the thread-twist changing device 326 is removed from the splicing chamber 314.

In a similar manner, the thread-twist changing device 319 has a shifting or displacing device 338 with a control valve 339. The end of the telescopic tube 340 of the shifting or displacing device 338 is connected to strap 342 carrying the bearing yoke 341. The bearing yoke 341, in turn, carries a thread holding member 343 which is provided with a gear 344. The V-shaped slit 345 has the same shape as the slit 333 of the thread holding member 330.

To make ready for the splicing operation, the threads are initially inserted as shown in FIG. 16. The thread end 316' of the lower thread 316 is located behind the thread picking or plucking device 329, and the thread end 315' of the upper thread 315 behind the thread picking or plucking device 322.

Before the splicing operation per se, the thread-twist changing devices 319 and 326 are initially rotated for once by means of the ring gear 313. The direction of rotation depends upon the thread twist. The thread grippers or clamps 318 and 325 must be closed beforehand if they are not constructed as springy or resilient thread grippers. The thread-twist changing members 319 and 326 receive enough rotations that no thread twists exist any more in the thread region between the thread picking or plucking devices and the thread-twist changing devices. In contrast thereto, a twist pile-up or accumulation should occur, respectively, between the thread gripper 318 and the thread-twist changing device 319, on the one hand, and between the thread gripper 325 and the thread-twist changing device 326, on the other hand, the twist accumulation being loosenable again later after the splicing operation and, be reverse rotation of the thread-twist changing device, being brought into the completed splicing location.

After these preparations, the splicing operation per se can be performed which, depending upon the type of splicing chamber, occurs due to compressed air impacts, electrostatic voltage impacts or the like. Thereafter, the thread picking or plucking devices 322 and 329 initially come into action. In this regard, the roller 320 is driven in direction of the arrow 347, and the roller 327 in direction of the arrow 348. Then, the thread ends are picked or plucked in vicinity of the splicing location. After that has occurred, the ring gear 313 is rotated back again to the starting position thereof. The completed, spliced thread can then be withdrawn towards the front, and the compressed-air splicing device is again operationally ready for a new splicing operation.

When splicing, it may also be possible for the thread picking or plucking devices to become actuated before the splicing connection is produced. The previously plucked or picked thread ends are then spliced together. This may be advantageous especially for somewhat thicker threads.

The thread-twist changing devices can also, for example, have a different construction. Instead of shifting the entire gear, it would be possible also, in a somewhat different construction, to provide a sliding or guide sleeve as a thread holding member in the interior of the gear and only to shift that sleeve.

As mentioned hereinbefore, the invention of the instant application is not limited to the illustrated and aforedescribed embodiments. As indicated, not only the entire but also the partial substitution of one of the devices for another is possible and practicable. In particular, the composite construction of the device of the first embodiment which is disassemblable into structural groups permits an integration of the illustrated and described variations and other embodiments.

The terms upper and lower threads are not restricted to being "upper" and "lower". By lower thread there is meant a thread coming from a thread feed or supply station, such as a supply cop, for example, or from a thread producer. The upper thread is a thread leading to a thread take-up station or location, such as a take-up coil or a winding beam. The thread travel direction can extend from below to above as is the case for the illustrated and described embodiments, however, the thread course may also be in opposite directions or any desired course in space, such as horizontally, for example.

Although the first embodiment of the invention relates to a traveling device for air-splicing, the device according to the invention can obviously also be disposed at each individual work station of a machine. Likewise, it is possible to provide a stationary splicing device according to the invention and to drive the work stations which are to be served by the splicing device successively past the stationary splicing device.

The device according to the invention is applicable, in addition to winding machines, also to spinning machines, creels and similar textile machines.

There are claimed:

1. Method of joining textile threads, respectively, formed of a plurality of twisted-together filaments by splicing the threads with the aid of compressed air, the threads being inserted into a splicing chamber having a compressed-air channel communicating therewith, the threads being fed from two sides of the splicing chamber and being held by respective thread holding members, which comprises, prior to splicing the threads, freeing the threads of the twist formed therein in a region thereof at which the splicing connection is to be formed, transferring the twist of the threads out of the region at which the splicing connection is to be formed and into a region of the threads extending from the splicing chamber to the thread holding members and, after splicing the threads, releasing the twist so that it can return to the splice location.

2. Method of joining textile threads, respectively, formed of a plurality of twisted-together filaments by splicing the threads with the aid of compressed air, the threads being inserted into a splicing chamber having a compressed-air channel communicating therewith, the threads being fed from two sides of the splicing chamber and being held by respective thread holding members, which comprises, prior to splicing the threads, freeing the threads of the twist formed therein in a region thereof at which the splicing connection is to be formed, and removing excessive lengths of ends of the threads by plucking.

3. Compressed-air splicing device for textile threads, respectively formed of a plurality of twisted-together filaments having a splicing chamber with which a compressed-air channel communicates, and thread holding members for holding respective textile threads inserted into the splicing chamber from two sides thereof, comprising a controllable thread-twist changing device disposed in a respective region of the threads extending from the splicing chamber to the respective thread holding members, said thread-twist changing device comprising a rotatable thread holding member.

4. Compressed-air splicing device for textile threads, respectively formed of a plurality of twisted-together filaments having a splicing chamber with which a compressed-air channel communicates, and thread holding members for holding respective textile threads inserted into the splicing chamber from two sides thereof, comprising a controllable thread-twist changing device disposed in a respective region of the threads extending from the splicing chamber to the respective thread holding members, and including a shifting device connected to said rotatable thread holding member of said thread-twist changing device for shifting said rotatable thread holding member along the axis of the respective thread.

5. Compressed-air splicing device for textile threads, respectively formed of a plurality of twisted-together filaments having a splicing chamber with which a compressed-air channel communicates, and thread holding members for holding respective textile threads inserted into the splicing chamber from two sides thereof, comprising a controllable thread-twist changing device disposed in a respective region of the threads extending from the splicing chamber to the respective thread holding members, each of said rotatable thread holding members of said thread-twist changing devices, respectively, comprising a gear having teeth meshing with the teeth of a ring gear common to said rotatable thread holding members.

6. Compressed-air splicing device for textile threads, respectively formed of a plurality of twisted-together filaments having a splicing chamber with which a compressed-air channel communicates, and thread holding members for holding respective textile threads inserted into the splicing chamber from two sides thereof, comprising a controllable thread-twist changing device disposed in a respective region of the threads extending from the splicing chamber to the respective thread holding members, said thread-twist changing device having at least one friction surface bringable into contact with the respective thread and displaceable transversely to the longitudinal direction of the respective thread.

7. Compressed-air splicing device for textile threads, respectively formed of a plurality of twisted-together filaments having a splicing chamber with which a compressed-air channel communicates, and thread holding members for holding respective textile threads inserted into the splicing chamber from two sides thereof, comprising a controllable thread-twist changing device disposed in a respective region of the threads extending from the splicing chamber to the respective thread holding members, said thread-twist changing device having at least two friction surfaces bringable from opposite sides into contact with the respective thread and displaceable away and returnable in opposite directions.

8. Device according to claim 7 wherein said thread-twist changing device has two oppositely rotatable, drivable halves formed with ring disk-like rims and surrounding the splicing chamber, said rims carrying said friction surfaces.

9. Device according to claim 8 including respective thread severing devices for separating the ends of the respective threads, the splicing chamber, said thread-twist changing device and said thread severing devices having a common housing, and further including a common actuating device for said thread-twist changing device and said thread severing devices, part of said actuating device being carried by said common housing and the remainder of said actuating device being disposed in another housing, both of said housings as well as associated elements of said actuating device being couplable to one another.

10. Device according to claim 9 including an adjustably sliding cover for the splicing chamber, said sliding cover being also actuatable by said actuating device in common with said thread-twist changing device and said thread severing devices, said other housing carrying two cam-disc actuatable levers, one of said levers serving, in turn, for actuating, in common, both halves of said thread-twist changing device with respect to the rotation thereof, and the other of said levers serving, in turn, for actuating said sliding cover, said thread severing devices and said thread-twist changing device with respect to the approach and removal of the two halves of the latter to and from one another, respectively.

11. Compressed-air splicing device for textile threads, respectively formed of a plurality of twisted-together filaments having a splicing chamber with which a compressed-air channel communicates, and thread holding members for holding respective textile threads inserted into the splicing chamber from two sides thereof, comprising a controllable thread-twist changing device disposed in a respective region of the threads extending from the splicing chamber to the respective thread holding members, said thread-twist changing device having a plurality of rollers rotatable in the same direction and spaced from one another a distance less than the diameter of the respective thread.

12. Device according to claim 11 wherein said rollers are tapered, the reduced-diameter end thereof being directed towards the splicing chamber.

13. Device according to claim 11 including a ring gear common to all of said rollers, said rollers carrying respective gears meshing with said common gear ring.

14. Device according to claim 13 wherein said rollers are formed as hollow members, are perforated and are connected to a suction air supply device.

15. Device according to claim 11 wherein the splice chamber has a variably adjustable volume.

16. Device according to claim 15 wherein the splicing chamber has a blast opening therein for delivering air thereto from the compressed air channel, said blast opening having a variably adjustable size.

17. Device according to claim 16 wherein said blast opening is increased and decreased in size in the same sense as the splicing chamber is increased and decreased in volume.

18. Device according to claim 16 wherein at least one side wall of the splicing chamber is formed as a slider adjustably slidable along a bottom and along said blast opening of the splicing chamber.

19. Device according to claim 18 including means for finely adjusting the movement of said adjustably slidable slider.

20. Compressed-air splicing device for textile threads, respectively formed of a plurality of twisted-together filaments having a splicing chamber with which a compressed-air channel communicates, and thread holding members for holding respective textile threads inserted into the splicing chamber from two sides thereof, comprising a controllable thread-twist changing device disposed in a respective region of the threads extending from the splicing chamber to the respective thread holding members, the splicing chamber having an adjustable sliding cover, and including respective thread severing members for the threads as well as a common actuating device for said thread-twist changing device, said sliding cover and said thread severing members.

21. Compressed-air splicing device for textile threads, respectively formed of a plurality of twisted-together filaments having a splicing chamber with which a compressed-air channel communicates, and thread holding members for holding respective textile threads inserted into the splicing chamber from two sides thereof, comprising a controllable thread-twist changing device disposed in a respective region of the threads extending from the splicing chamber to the respective thread holding members, and including thread severing means for removing the ends of the threads, said thread severing means comprising plucking devices for the respective threads.

22. Device according to claim 21 wherein said plucking device comprises a traveling gripper.

23. Device according to claim 21 wherein said plucking device comprises a respective roller pair engageable with the threads for acting thereon.

* * * * *